US010500855B2

(12) United States Patent
Irokawa

(10) Patent No.: US 10,500,855 B2
(45) Date of Patent: Dec. 10, 2019

(54) HEAD CHIP, LIQUID JET HEAD AND LIQUID JET RECORDING DEVICE

(71) Applicant: SII Printek Inc., Chiba-shi, Chiba (JP)

(72) Inventor: Daiki Irokawa, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 16/117,607

(22) Filed: Aug. 30, 2018

(65) Prior Publication Data

US 2019/0061350 A1 Feb. 28, 2019

(30) Foreign Application Priority Data

Aug. 31, 2017 (JP) ..... 2017-166724

(51) Int. Cl.
*B41J 2/14* (2006.01)

(52) U.S. Cl.
CPC ..... *B41J 2/14209* (2013.01)

(58) Field of Classification Search
CPC .. B41J 2/14201; B41J 2/14209; B41J 2/1433; B41J 2202/12; B41J 2002/14475; B41J 2002/14362; B41J 2202/08
See application file for complete search history.

(56) References Cited

U.S. PATENT DOCUMENTS

| | | | | |
|---|---|---|---|---|
| 8,157,354 | B2 * | 4/2012 | Koseki | B41J 2/14209 347/40 |
| 2006/0017778 | A1 | 1/2006 | Okuno | |
| 2006/0119663 | A1 | 6/2006 | Tsuchii | |
| 2008/0018679 | A1 * | 1/2008 | Kojima | B41J 2/14233 347/9 |

FOREIGN PATENT DOCUMENTS

| | | | |
|---|---|---|---|
| EP | 2 130 677 | A1 | 12/2009 |
| EP | 2 891 556 | A1 | 7/2015 |
| JP | H10-157119 | A | 6/1998 |
| JP | 2006-035454 | A | 2/2006 |
| JP | 2006-224456 | A | 8/2006 |
| JP | 2016-055543 | A | 4/2016 |
| JP | 2016-074188 | A | 5/2016 |
| JP | 2017-052214 | A | 3/2017 |
| WO | WO 2017/073668 | A1 | 5/2017 |

OTHER PUBLICATIONS

Extended European Search Report dated Jan. 8, 2019 for European Application No. 18191851.7, 9 pages.

* cited by examiner

*Primary Examiner* — Geoffrey S Mruk

(74) *Attorney, Agent, or Firm* — Brinks Gilson & Lione

(57) ABSTRACT

There are provided a head chip, a liquid jet head, and a liquid jet recording device capable of enhancing the reliability. The head chip according to an embodiment of the disclosure includes a first plate having a plurality of pressure chambers adapted to apply pressure to a liquid, a second plate having a plurality of nozzle holes adapted to jet the liquid in response to application of the pressure, and a third plate disposed between the first and second plates, and provided with a plurality of through holes individually communicated with the plurality of pressure chambers and the plurality of nozzle holes, respectively. In the through hole, a second opening region opposed to the second plate is larger than a first opening region opposed to the first plate.

7 Claims, 15 Drawing Sheets

HEAD CHIP, LIQUID JET HEAD AND LIQUID JET RECORDING DEVICE

RELATED APPLICATIONS

This application claims priority under 35 U.S.C. § 119 to Japanese Patent Application No. 2017-166724 filed on Aug. 31, 2017, the entire content of which is hereby incorporated by reference.

BACKGROUND OF THE INVENTION

1. Field of the Invention

The present disclosure relates to a head chip, a liquid jet head and a liquid jet recording device.

2. Description of the Related Art

As one of liquid jet recording devices, there is provided an inkjet type recording device for ejecting (jetting) ink (liquid) on a recording target medium such as recording paper to perform recording of images, characters, and so on (see, e.g., JP-A-2006-35454).

In the liquid jet recording device of this type, it is arranged that ink is supplied from an ink tank to an inkjet head (a liquid jet head), and then the ink is ejected from nozzle holes toward the recording target medium to thereby perform recording of the images, the characters, and so on. Further, such an inkjet head is provided with a head chip for ejecting the ink.

In such a head chip or the like, in general, it is required to enhance the reliability. It is desirable to provide a head chip, a liquid jet head, and a liquid jet recording device capable of enhancing the reliability.

SUMMARY OF THE INVENTION

The head chip according to an embodiment of the disclosure includes a first plate having a plurality of pressure chambers adapted to apply pressure to a liquid, a second plate having a plurality of nozzle holes adapted to jet the liquid in response to application of the pressure, and a third plate disposed between the first and second plates, and provided with a plurality of through holes individually communicated with the plurality of pressure chambers and the plurality of nozzle holes, respectively. In the through hole, a second opening region opposed to the second plate is larger than a first opening region opposed to the first plate.

A liquid jet head according to an embodiment of the disclosure includes the head chip according to an embodiment of the disclosure, and a supply mechanism adapted to supply the liquid to the head chip.

A liquid jet recording device according to an embodiment of the disclosure includes the liquid jet head according to an embodiment of the disclosure, and a containing section adapted to contain the liquid.

According to the head chip, the liquid jet head and the liquid jet recording device related to an embodiment of the disclosure, it becomes possible to enhance the reliability.

DETAILED DESCRIPTION OF THE PREFERRED EMBODIMENTS

Some embodiments of the disclosure will hereinafter be described in detail with reference to the drawings. It should be noted that the description will be presented in the following order:

1. Embodiment (Example 1 of the case in which an intermediate plate has inverse tapered through holes)

2. Modified Examples

Modified Example 1 (Example 2 of the case in which the intermediate plate has inverse tapered through holes)

Modified Example 2 (Example of the case in which the intermediate plate has step-like through holes)

Modified Examples 3 (Example 1 of a liquid circulation system: Example in which the intermediate plate also functions as a return plate)

Modified Examples 4 (Example 2 of the liquid circulation system: Example in which the return plate is separately disposed)

3. Other Modified Examples

1. EMBODIMENT

[Overall Configuration of Printer 1]

Figure 1:
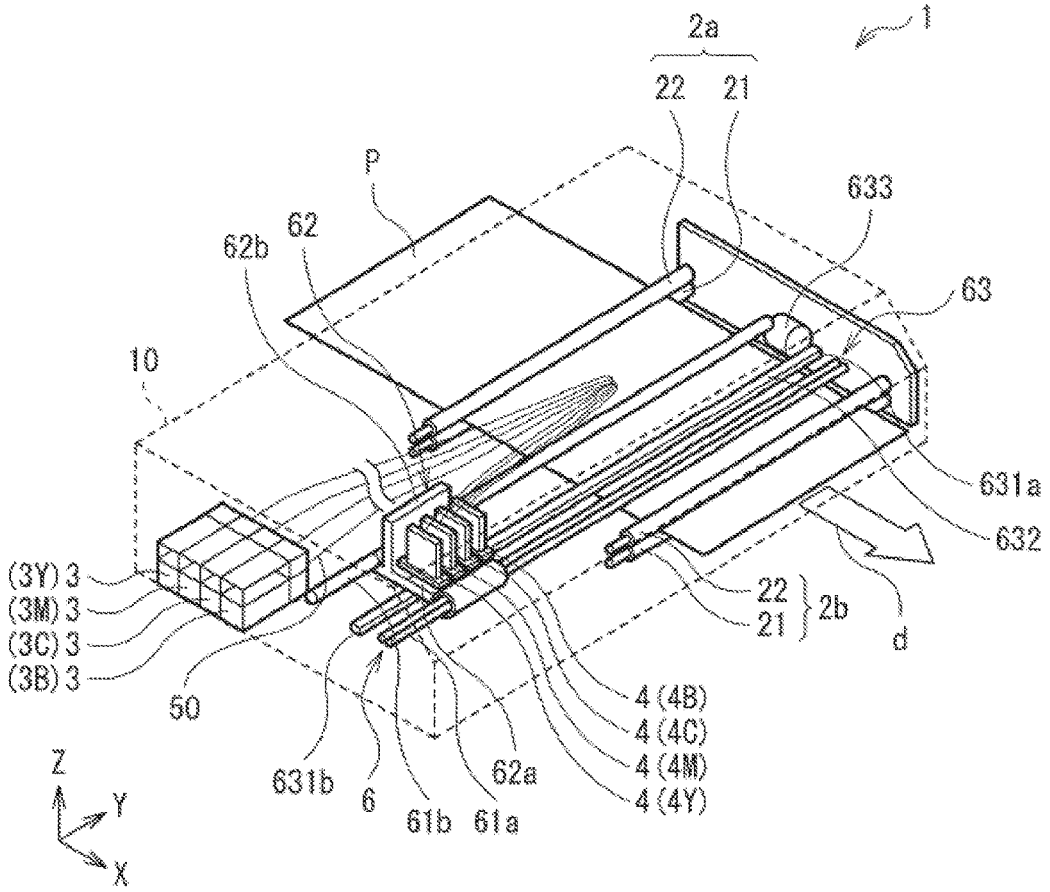
FIG. 1 is a schematic perspective view showing a schematic configuration Example of a liquid jet recording device according to one embodiment of the disclosure.

FIG. 1 is a perspective view schematically showing a schematic configuration Example of a printer 1 as a liquid jet recording device according to one embodiment of the present disclosure. The printer 1 is an inkjet printer for performing recording (printing) of images, characters, and so on on recording paper P as a recording target medium using ink 9 described later.

As shown in FIG. 1, the printer 1 is provided with a pair of carrying mechanisms 2*a*, 2*b*, ink tanks 3, inkjet heads 4, supply tubes 50, and a scanning mechanism 6. These members are housed in a housing 10 having a predetermined shape. It should be noted that the scale size of each member is accordingly altered so that the member is shown large enough to recognize in the drawings used in the description of the specification.

Here, the printer 1 corresponds to a specific Example of the "liquid jet recording device" in the present disclosure, and the inkjet heads 4 (the inkjet heads 4Y, 4M, 4C, and 4B described later) each correspond to a specific Example of a "liquid jet head" in the present disclosure. Further, the ink 9 corresponds to a specific Example of the "liquid" in the present disclosure.

The carrying mechanisms 2*a*, 2*b* are each a mechanism for carrying the recording paper P along the carrying direction d (an X-axis direction) as shown in FIG. 1. These carrying mechanisms 2*a*, 2*b* each have a grid roller 21, a pinch roller 22 and a drive mechanism (not shown). The grid roller 21 and the pinch roller 22 are each disposed so as to extend along a Y-axis direction (the width direction of the recording paper P). The drive mechanism is a mechanism for rotating (rotating in a Z-X plane) the grid roller 21 around an axis, and is constituted by, for example, a motor.

(Ink Tanks 3)

The ink tanks 3 are each a tank for containing the ink 9 inside. As the ink tanks 3, there are disposed 4 types of tanks for individually containing 4 colors of ink 9, namely yellow (Y), magenta (M), cyan (C), and black (B), in this Example as shown in FIG. 1. Specifically, there are disposed the ink tank 3Y for containing the yellow ink 9, the ink tank 3M for containing the magenta ink 9, the ink tank 3C for containing the cyan ink 9, and the ink tank 3B for containing the black ink 9. These ink tanks 3Y, 3M, 3C, and 3B are arranged side by side along the X-axis direction in the housing 10.

It should be noted that the ink tanks 3Y, 3M, 3C, and 3B have the same configuration except the color of the ink 9 contained, and are therefore collectively referred to as ink tanks 3 in the following description. Further, the ink tanks 3 (3Y, 3M, 3C, and 3B) correspond to an Example of a "containing section" in the present disclosure.

(Inkjet Head 4)

The inkjet heads 4 are each a head for jetting (ejecting) the ink 9 having a droplet shape from a plurality of nozzles (nozzle holes H2) described later to the recording paper P to thereby perform printing of images, characters, and so on. As the inkjet heads 4, there are also disposed 4 types of heads for individually jetting the 4 colors of ink 9 respectively contained by the ink tanks 3Y, 3M, 3C, and 3B described above in this Example as shown in FIG. 1. Specifically, there are disposed the inkjet head 4Y for jetting the yellow ink 9, the inkjet head 4M for jetting the magenta ink 9, the inkjet head 4C for jetting the cyan ink 9, and the inkjet head 4B for jetting the black ink 9. These inkjet heads 4Y, 4M, 4C, and 4B are arranged side by side along the Y-axis direction in the housing 10.

Figure 2:
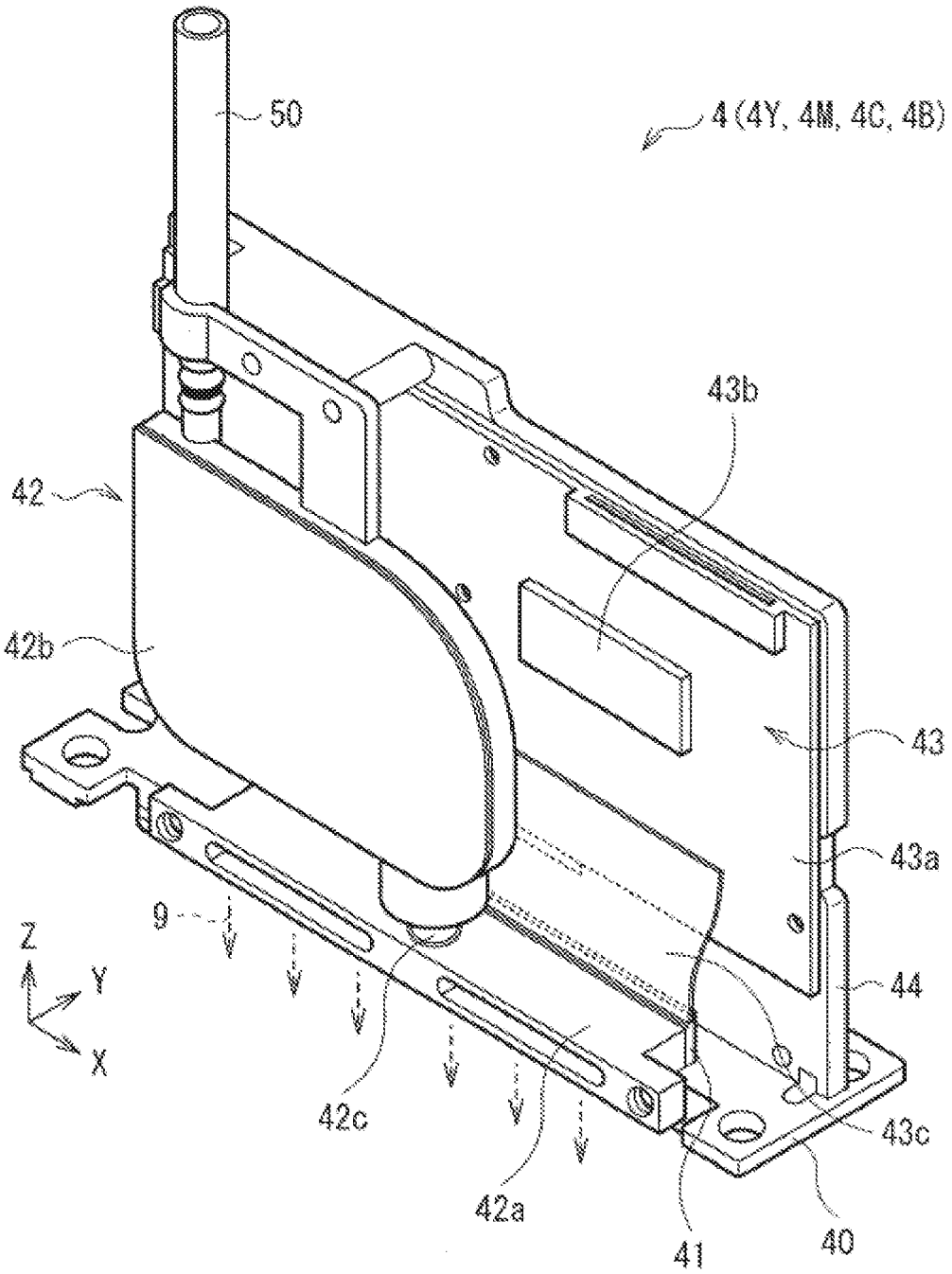
FIG. 2 is a perspective view showing a detailed configuration Example of the liquid jet head shown in FIG. 1.

It should be noted that the inkjet heads 4Y, 4M, 4C, and 4B have the same configuration except the color of the ink 9 used, and are therefore collectively referred to as inkjet heads 4 in the following description. Further, the detailed configuration of the inkjet heads 4 will be described later in detail (FIG. 2).

The supply tubes 50 are each a tube for supplying the ink 9 from the inside of the ink tank 3 to the inside of the inkjet head 4.

(Scanning Mechanism 6)

The scanning mechanism 6 is a mechanism for making the inkjet heads 4 perform a scanning operation along the width direction (the Y-axis direction) of the recording paper P. As shown in FIG. 1, the scanning mechanism 6 has a pair of guide rails 61*a*, 61*b* disposed so as to extend along the Y-axis direction, a carriage 62 movably supported by these guide rails 61*a*, 61*b*, and a drive mechanism 63 for moving the carriage 62 along the Y-axis direction. Further, the drive mechanism 63 is provided with a pair of pulleys 631*a*, 631*b* disposed between the pair of guide rails 61*a*, 61*b*, an endless belt 632 wound between the pair of pulleys 631*a*, 631*b*, and a drive motor 633 for rotationally driving the pulley 631*a*.

The pulleys 631*a*, 631*b* are respectively disposed in areas corresponding to the vicinities of both ends in each of the guide rails 61*a*, 61*b* along the Y-axis direction. To the endless belt 632, there is connected the carriage 62. The carriage 62 has a pedestal 62*a* having a plate-like shape for mounting the four types of inkjet heads 4Y, 4M, 4C, and 4B described above, and a wall section 62*b* erected vertically (in the Z-axis direction) from the pedestal 62*a*. On the pedestal 62*a*, the inkjet heads 4Y, 4M, 4C, and 4B are arranged side by side along the Y-axis direction.

It should be noted that it is arranged that a moving mechanism for moving the inkjet heads 4 relatively to the recording paper P is constituted by such a scanning mechanism 6 and the carrying mechanisms 2*a*, 2*b* described above.

[Detailed Configuration of Inkjet Heads 4]

Then, the detailed configuration Example of the inkjet heads 4 will be described with reference to FIG. 2 in addition to FIG. 1. FIG. 2 is a perspective view showing the detailed configuration Example of the inkjet heads 4.

The inkjet heads 4 according to the present embodiment are each an inkjet head of a so-called edge-shoot type for ejecting the ink 9 along an extending direction (the Z-axis direction) of a plurality of channels (channels C1) in a head chip 41 described later.

As shown in FIG. 2, the inkjet heads 4 are each provided with a fixation plate 40, the head chip 41, a supply mechanism 42, a control mechanism 43 and a base plate 44.

As shown in FIG. 2, the fixation plate 40 is a plate-like member for fixing a variety of members in each of the inkjet heads 4. Specifically, on an upper surface of the fixation plate 40, there are fixed the head chip 41, a flow channel member 42*a* described later in the supply mechanism 42, and the base plate 44.

The base plate 44 is a rectangular plate formed of a metal material such as aluminum (Al). The base plate 44 is fixed in the state of erecting vertically (in the Z-axis direction) on the upper surface of the fixation plate 40.

As shown in FIG. 2, the head chip 41 is a member for jetting the ink 9 along the Z-axis direction, and is configured using a variety of types of plates described later. It should be noted that the detailed configuration of such a head chip 41 will be described later (FIG. 3 through FIG. 6, and FIGS. 7A through 7C).

(Supply Mechanism 42)

The supply mechanism 42 is a mechanism for supplying the head chip 41 (an ink introducing hole 410*a* described later) with the ink 9 having been supplied via the supply tube 50 described above. As shown in FIG. 2, the supply mechanism 42 has the flow channel member 42*a*, a pressure buffer 42*b* and an ink connection pipe 42*c*.

The flow channel member 42*a* is a member functioning as a flow channel through which the ink 9 flows, and is fixed on the upper surface of the fixation plate 40. The pressure buffer 42*b* is disposed above the flow channel member 42*a* in the state of being supported by the base plate 44 described above. The pressure buffer 42*b* has a reservoir chamber inside, and the ink 9 is reserved in the reservoir chamber. Such pressure buffer 42*b* and flow channel member 42*a* are connected to each other via the ink connection pipe 42*c*. It should be noted that the supply tube 50 described above is attached to an upper part of the pressure buffer 42*b*.

Due to such a configuration, when the ink 9 is supplied to the pressure buffer 42*b* via the supply tube 50, the ink 9 is once reserved in the reservoir chamber in the pressure buffer 42*b* in the supply mechanism 42. Further, the pressure buffer 42*b* is arranged to supply a predetermined amount of ink 9 reserved in the reservoir chamber to the inside (the ink introducing hole 410*a*) of the head chip 41 via the ink connection pipe 42*c* and the flow channel member 42*a*.

(Control Mechanism 43)

As shown in FIG. 2, the control mechanism 43 has a circuit board 43*a*, a drive circuit 43*b* and a flexible board 43*c*, and is a mechanism for controlling (driving the head chip 41) an action of the head chip 41.

The circuit board 43*a* is a board for mounting the drive circuit 43*b* for driving the head chip 41. The circuit board 43*a* is fixed to the base plate 44, and is erected in the vertical direction (the Z-axis direction) to the fixation plate 40. It should be noted that the drive circuit 43*b* is formed of, for example, an integrated circuit (IC).

The flexible board 43*c* is a board for electrically connecting between the drive circuit 43*b* described above and a drive electrode Ed described later in the head chip 41. It is arranged that a plurality of extraction electrodes Ee described later is provided as printed wiring to such a flexible board 43*c*.

[Detailed Configuration of Head Chip 41]

Figure 3:
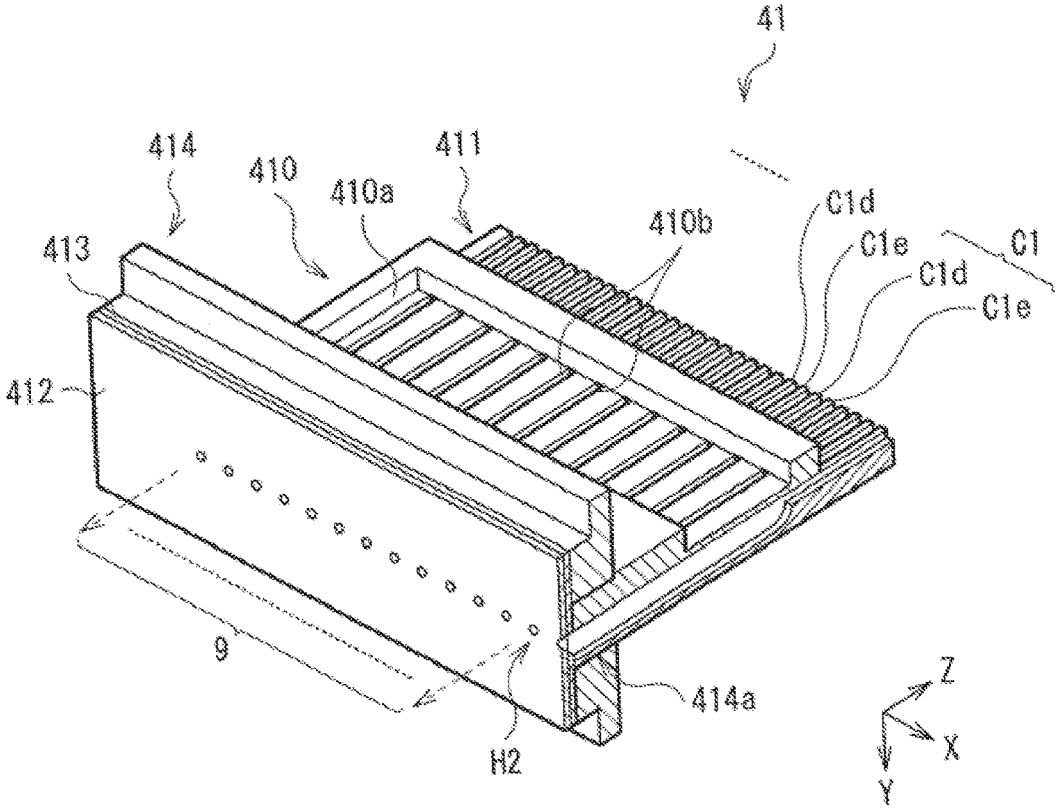
FIG. 3 is a perspective view showing a detailed configuration Example of a head chip shown in FIG. 2.
Figure 4:
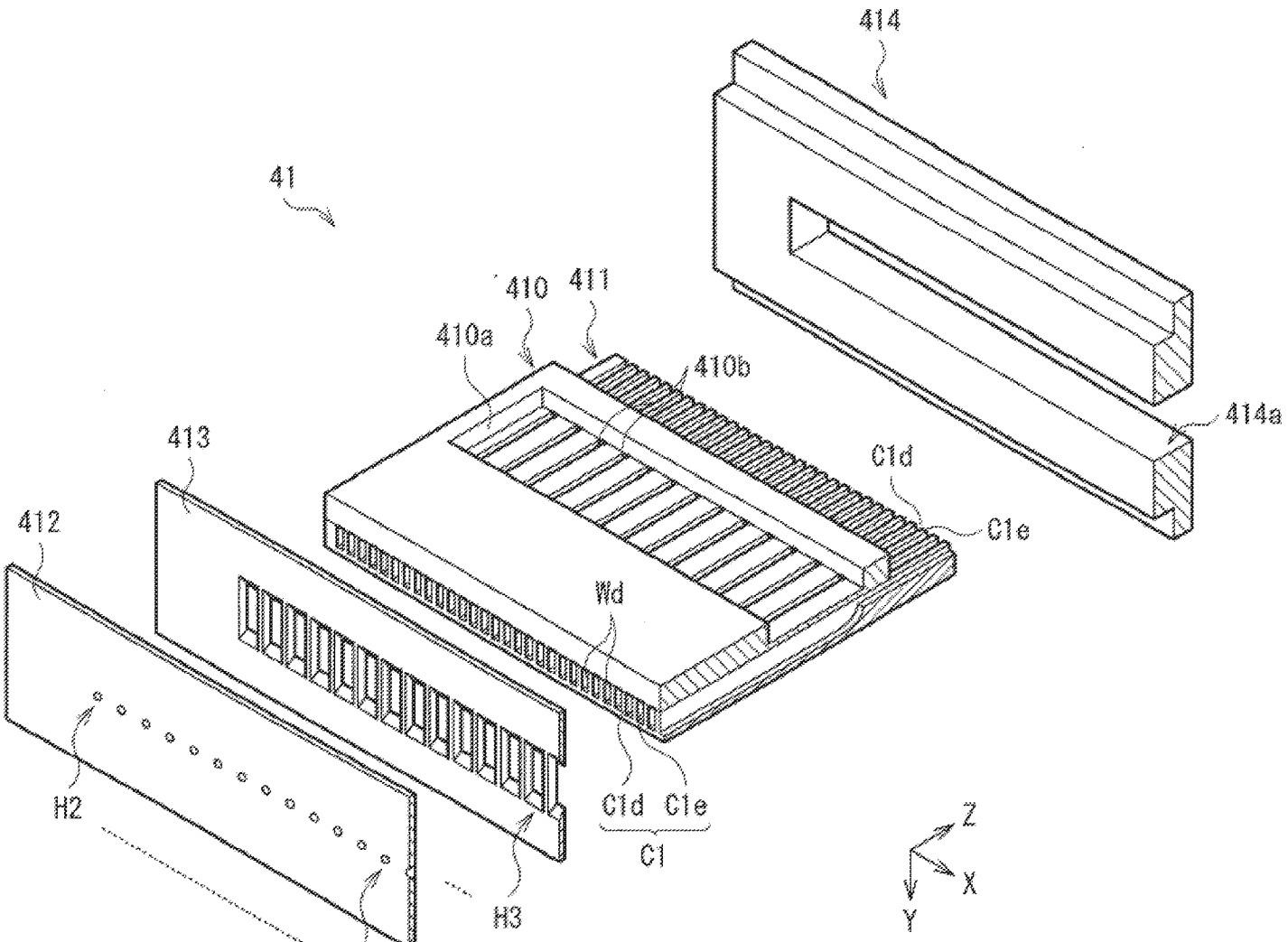
FIG. 4 is an exploded perspective view of the head chip shown in FIG. 3.
Figure 5:
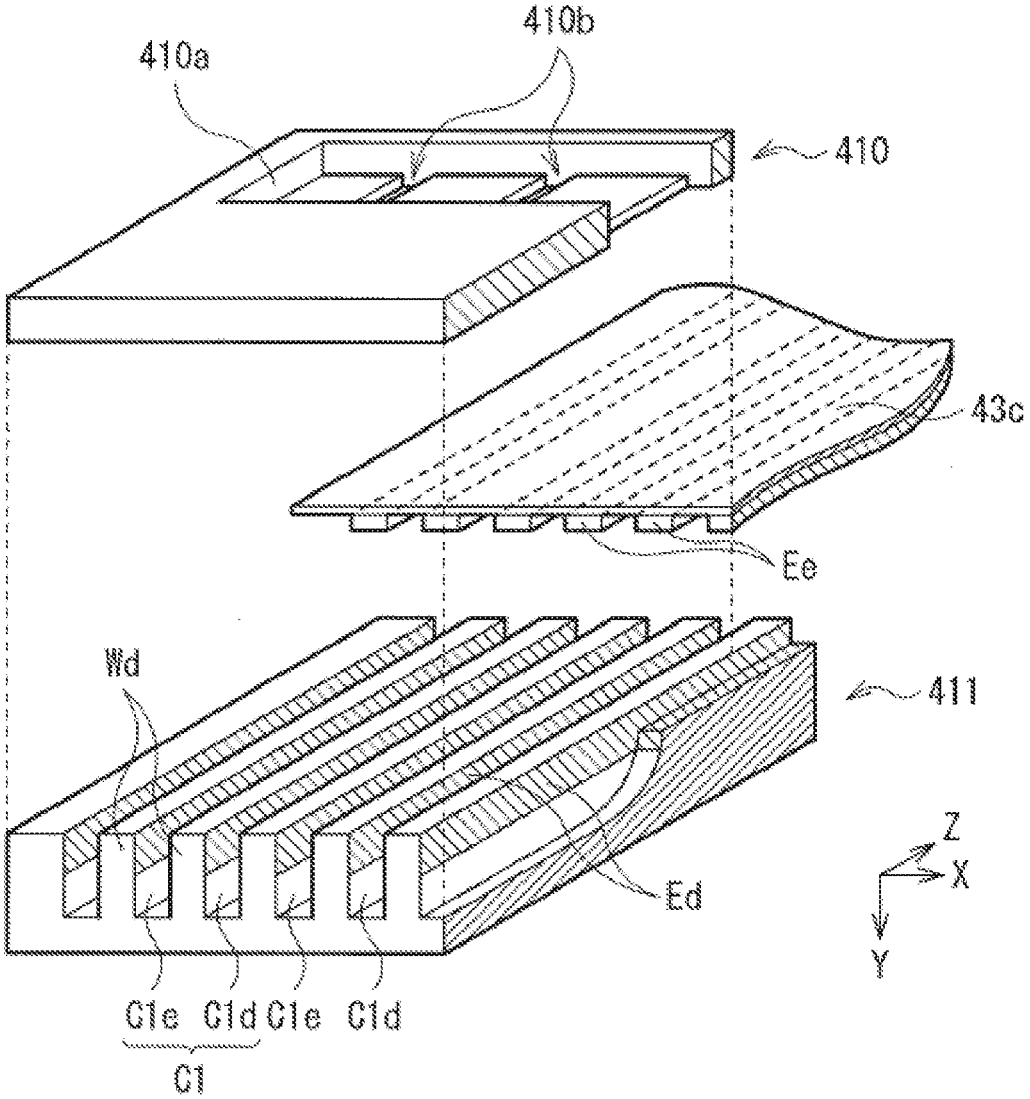
FIG. 5 is an exploded perspective view showing a part of the head chip shown in FIG. 4 in an enlarged manner.
Figure 6:
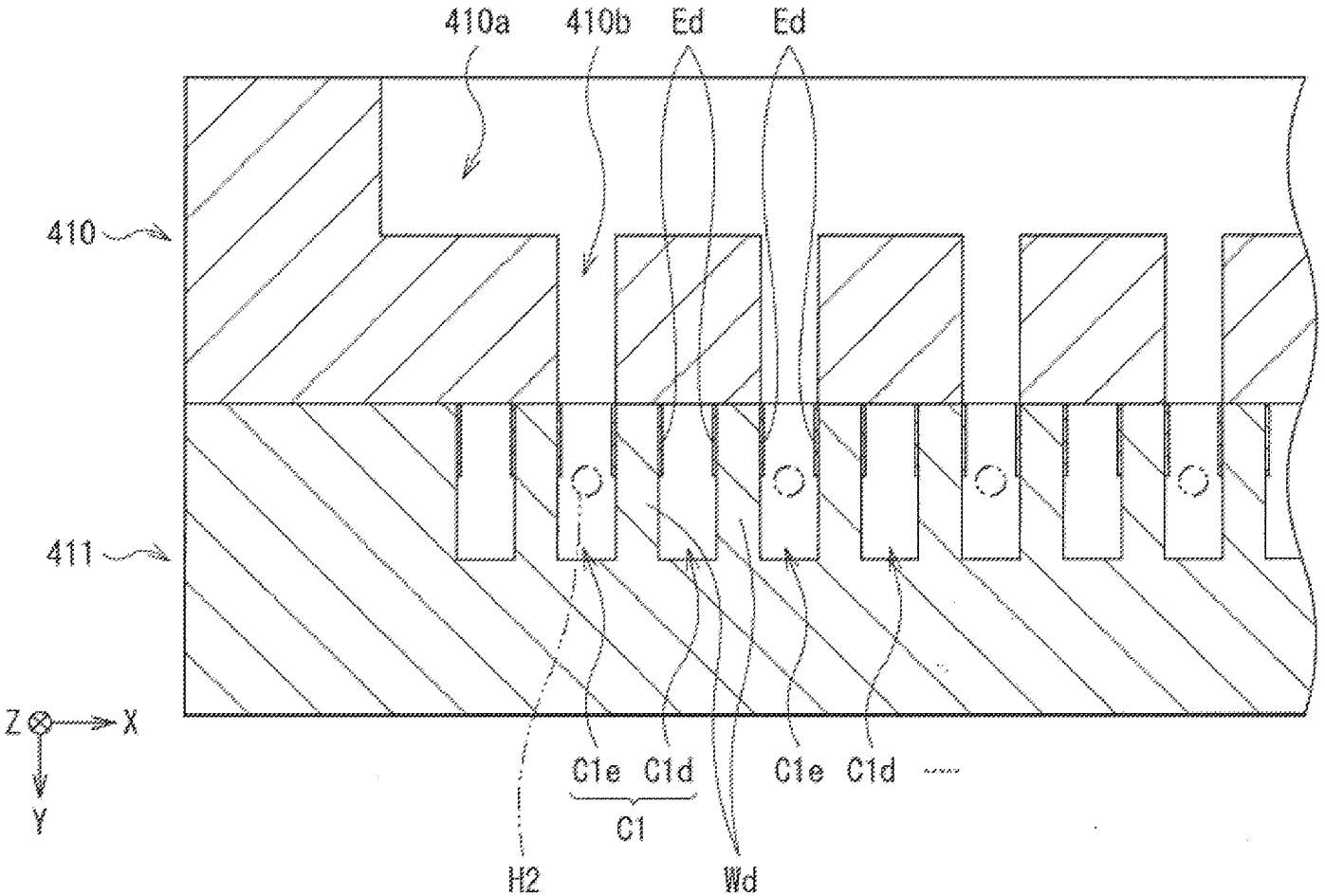
FIG. 6 is a cross-sectional view showing a part of the head chip shown in FIG. 3 in an enlarged manner.

Then, the detailed configuration Example of the head chip 41 will be described with reference to FIG. 3 through FIG. 6, and FIGS. 7A through 7C in addition to FIG. 2. FIG. 3 is a perspective view showing the detailed configuration Example of the head chip 41, and FIG. 4 is an exploded perspective view showing the detailed configuration Example of the head chip 41. Further, FIG. 5 is an exploded perspective view showing a part of the head chip 41 shown in FIG. 4 in an enlarged manner, and FIG. 6 is a cross-sectional view (a cross-sectional view in an X-Y plane) showing a part of the head chip 41 shown in FIG. 3 in an enlarged manner.

As shown in FIG. 3 and FIG. 4, the head chip 41 is mainly provided with a cover plate 410, an actuator plate 411, a nozzle plate (a jet hole plate) 412, an intermediate plate (a spacer plate) 413 and a support plate 414. Specifically, the cover plate 410 is disposed above (on the upper side along the Y-axis direction of) the actuator plate 411. Further, as shown in FIG. 3, the actuator plate 411, the cover plate 410 and the support plate 414, the intermediate plate 413, and the nozzle plate 412 are disposed so as to be stacked in this order along the Z-axis direction. It should be noted that these members are bonded with each other using, for example, an adhesive.

(Actuator Plate 411)

The actuator plate 411 is a plate formed of a piezoelectric material such as lead zirconate titanate (PZT). As shown in FIG. 3 through FIG. 6, the actuator plate 411 is provided with a plurality of channels C1 each extending along the Z-axis direction. Although described later in detail, these channels C1 are each a part functioning as a pressure chamber for applying pressure to the ink 9, and are arranged side by side so as to be parallel to each other with predetermined intervals along the X-axis direction. Each of the channels C1 is partitioned with drive walls Wd formed of a piezoelectric body (the actuator plate 411), and forms a groove section having a recessed shape in a cross-sectional view (see FIG. 5 and FIG. 6).

Further, these channels C1 (groove sections) are each formed so as to open on the front end surface side (on the side facing the intermediate plate 413) of the actuator plate 411 (see FIG. 4 and FIG. 5), and at the same time formed so as to gradually decrease in depth toward the back end surface. It should be noted that the back end surface side of each of the channels C1 is arranged to be sealed with a sealing member not shown.

Here, as shown in FIG. 3 through FIG. 6, in such channels C1, there exist ejection channels C1*e* for ejecting the ink 9, and dummy channels (non-ejection channels) C1*d* not ejecting the ink 9. In other words, it is arranged that the ejection channels C1*e* are filled with the ink 9 on the one hand, but the dummy channels C1*d* are not filled with the ink 9 on the other hand. Further, as shown in FIG. 6, each of the ejection channels C1*e* is communicated with the nozzle hole H2 in the nozzle plate 412 described later on the one hand, but each of the dummy channels C1*d* is not communicated with the nozzle hole H2, and is covered with the cover plate described later from above. The ejection channels C1*e* and the dummy channels C1*d* are alternately arranged side by side along the X-axis direction as shown in FIG. 3 through FIG. 6.

Here, as shown in FIG. 5 and FIG. 6, the drive electrode Ed extending along the Z-axis direction is disposed on each of the inside surfaces opposed to each other in the drive walls Wd described above. As the drive electrodes Ed, there exist common electrodes disposed on the inside surfaces facing the ejection channels C1*e*, and active electrodes disposed on the inside surfaces facing the dummy channels C1*d*. It should be noted that such drive electrodes Ed (the common electrodes and the active electrodes) are each formed only to an intermediate position in the depth direction (the Y-axis direction) on the inside surface of the drive wall Wd.

Further, the pair of drive electrodes Ed (the common electrodes) opposed to each other in the same ejection channel C1*e* are electrically connected to each other in a common terminal (not shown). Further, the pair of drive electrodes Ed (the active electrodes) opposed to each other in the same dummy channel C1*d* are electrically separated from each other. In contrast, the pair of drive electrodes Ed (the active electrodes) opposed to each other via the ejection channel C1*e* are electrically connected to each other in an active terminal (not shown).

Here, as described above, these drive electrodes Ed and the drive circuit 43*b* in the circuit board 43*a* are electrically connected to each other via the plurality of extraction electrodes Ee provided to the flexible board 43*c* (see FIG. 3 and FIG. 5). Thus, it is arranged that the drive voltage is applied to each of the drive electrodes Ed from the drive circuit 43*b* via the flexible board 43*c*. It should be noted that it is arranged that the drive voltage is applied so that the drive electrodes Ed (the common electrodes) disposed inside the ejection channels C1*e* and the drive electrodes Ed (the active electrodes) disposed inside the dummy channels C1*d* become different in polarity from each other on this occasion.

It should be noted that such an actuator plate 411 corresponds to a specific Example of a "first plate" in the present disclosure. Further, each of the channels C1 in the actuator plate 411 corresponds to a specific Example of a "pressure chamber" in the present disclosure.

(Cover Plate 410)

As shown in FIG. 3 through FIG. 6, the cover plate 410 is disposed on the upper surface of the actuator plate 411, and has a plate-like structure. Further, as shown in FIG. 3 and FIG. 4, the cover plate 410 is provided with the ink introducing hole 410*a* supplied with the ink 9 formed so as to extend along the X-axis direction. The ink introducing hole 410*a* is formed of a groove section having a recessed shape.

In the ink introducing hole 410*a*, a plurality of slits 410*b* penetrating the cover plate 410 along the thickness direction (the Y-axis direction) is formed in the respective areas corresponding to the ejection channels C1*e* of the actuator plate 411 as shown in FIG. 3 through FIG. 6. These slits 410*b* are formed so as to extend along the Z-axis direction similarly to the extending direction of the ejection channels C1*e*. Further, the ink introducing hole 410*a* is communicated with the ejection channels C1*e* via the respective slits 410*b* on the one hand, but is not communicated with the dummy channels C1*d* on the other hand. Specifically, each of the dummy channels C1*d* is arranged to be closed by a bottom part of the ink introducing hole 410*a*. In such a manner, it is arranged that each of the ejection channels C1*e* is filled with the ink 9 on the one hand, but each of the dummy channels C1*d* is not filled with the ink 9 on the other hand.

(Support Plate 414)

As shown in FIG. 3 and FIG. 4, the support plate 414 is arranged to support the actuator plate 411 and the cover plate 410 stacked on one another, and at the same time also support the nozzle plate 412 and the intermediate plate 413 described later.

As shown in FIG. 4, the support plate 414 is provided with a fitting hole 414*a* extending along the X-axis direction. The actuator plate 411 and the cover plate 410 stacked on one another are supported in the stated of being fitted in the fitting hole 414*a*. On this occasion, as shown in FIG. 3, the position of an end surface of the support plate 414 facing the intermediate plate 413 is arranged to coincide with each of the positions of the front end surfaces (the end surfaces facing the intermediate plate 413) of the actuator plate 411 and the cover plate 410.

Further, the nozzle plate 412 is bonded to the end surface of the support plate 414 facing the intermediate plate 413 and the front end surfaces of the actuator plate 411 and the cover plate 410 using an adhesive in the state in which the intermediate plate 413 intervenes therebetween.

(Nozzle Plate 412)

The nozzle plate 412 is a plate formed of a film member made of polyimide or the like having a thickness of, for example, about 50 μm. In this nozzle plate 412, one surface forms a bonding surface to be bonded to the intermediate plate 413, and the other surface forms an opposed surface to be opposed to the recording paper P. It should be noted that the opposed surface is coated with a lyophobic film (not shown) having a lyophobic property in order to prevent the ink 9 from adhering.

Further, as shown in FIG. 3 and FIG. 4, the nozzle plate 412 is provided with a nozzle column extending along the X-axis direction. The nozzle column has a plurality of nozzle holes H2 formed so as to be arranged in a straight line with predetermined intervals along the X-axis direction. These nozzle holes H2 each penetrate the nozzle plate 412 along the Z-axis direction, and are communicated with the respective ejection channels C1*e* in the actuator plate 411 as shown in, for example, FIG. 6. Further, the formation pitch along the X-axis direction in the nozzle holes H2 is arranged to be equal (to have an equal pitch) to the formation pitch along the X-axis direction in the ejection channels C1*e*. Further, as shown in FIG. 6, each of the nozzle holes H2 is formed so as to be located around the center in the X-axis direction in each of the ejection channels C1*e*.

Each of such nozzle holes H2 is formed so that the cross-sectional surface (the cross-sectional surface in the X-Y plane) thereof has, for example, a circular shape. Further, although the details will be described later (FIGS. 7A through 7C), in each of the nozzle holes H2, an inlet diameter Rin located closer to the bonding surface (facing the intermediate plate 413) described above is larger than an outlet diameter Rout located closer to the opposed surface (facing the recording paper P) described above. In other words, the cross-sectional surface of each of the nozzle holes H2 has a tapered shape gradually decreasing in diameter toward the outlet. It should be noted that such nozzle holes H2 are formed using, for example, an excimer laser device.

Although the details will be described later, it is arranged that the ink 9 supplied from the inside of the ejection channel C1*e* is ejected (jetted) from each of such nozzle holes H2 in response to application of the pressure. It should be noted that such a nozzle plate 412 corresponds to a specific Example of a "second plate" in the present disclosure.

(Intermediate Plate 413)

As shown in FIG. 3 and FIG. 4, the intermediate plate 413 is disposed between an assembly consisting of the actuator plate 411, the cover plate 410 and the support plate 414, and the nozzle plate 412 in the Z-axis direction, and is bonded to each of these members using an adhesive. In other words, although the details will be described later (FIGS. 7A through 7C), the intermediate plate 413 is disposed between the actuator plate 411 and the nozzle plate 412.

Further, as shown in FIG. 4, the intermediate plate 413 has a plurality of through holes H3 formed so as to be arranged in a straight line with predetermined intervals along the X-axis direction. In this example, these through holes H3 each have a rectangular cross-sectional shape having a long axis in the Y-axis direction and a short axis in the X-axis direction, and each penetrate the intermediate plate 413 along the thickness direction (the Z-axis direction) of the intermediate plate 413. Further, these through holes H3 are individually communicated with the inside of the plurality of ejection channels C1*e* in the actuator plate 411 and the inside of the plurality of nozzle holes H2 in the nozzle plate 412, respectively. Further, the formation pitch along the X-axis direction in the through holes H3 is arranged to be equal (to have an equal pitch) to the formation pitch along the X-axis direction in the ejection channels C1*e*, and the formation pitch along the X-axis direction in the nozzle holes H2.

Such an intermediate plate 413 is formed of a material such as ceramic or polyimide, but the material can freely be selected as long as the material is resistant to the ink 9. Further, the intermediate plate 413 is arranged to be bonded to the assembly of the actuator plate 411 and the cover plate 410, and the nozzle plate 412. Therefore, it is desirable for the plates (the intermediate plate 413, the actuator plate 411, the cover plate 410 and the nozzle plate 412) to have roughly equivalent thermal deformation characteristics so that the thermal deformations in the plates become roughly equivalent to each other. Further, it is desirable for the thermal expansion coefficient K3 in the intermediate plate 413 to be a value between the thermal expansion coefficient K1 in the actuator plate 411 and the thermal expansion coefficient K2 in the nozzle plate 412. Specifically, it is desirable to set the value so as to fulfill the magnitude relation of (K1≥K3≥K2) or (K1≤K3≤K2). This is because in the case of setting the value so as to fulfill such a magnitude relation, even in the case in which, for example, a thermal deformation (expansion or contraction due to the heat) of the nozzle plate 412 occurs in the bonding process of the plates described above, it is possible to absorb such a thermal deformation in the intermediate plate 413.

Figure 7A:
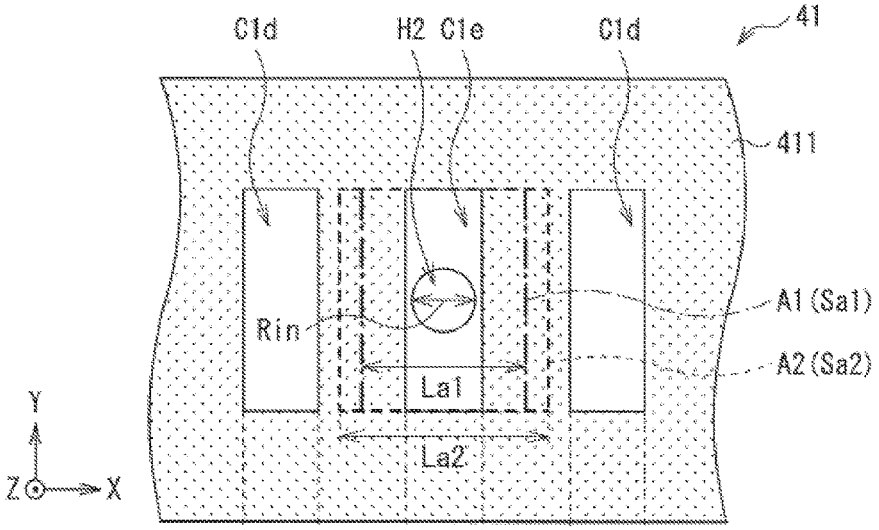
FIG. 7A is a schematic plan view showing a part of the head chip shown in FIG. 3 in an enlarged manner.
Figure 7B:
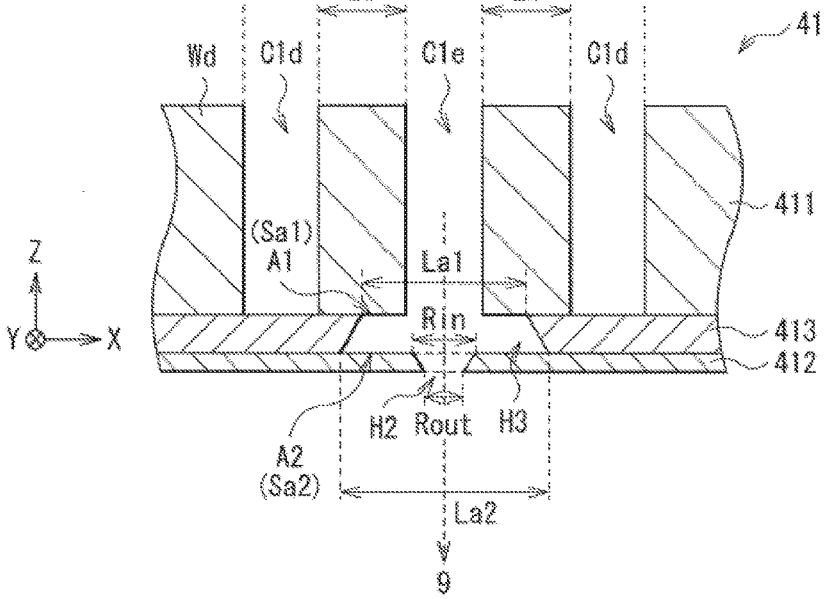
FIGS. 7B and 7C are schematic cross-sectional views showing a part of the head chip shown in FIG. 3 in an enlarged manner.
Figure 7C:
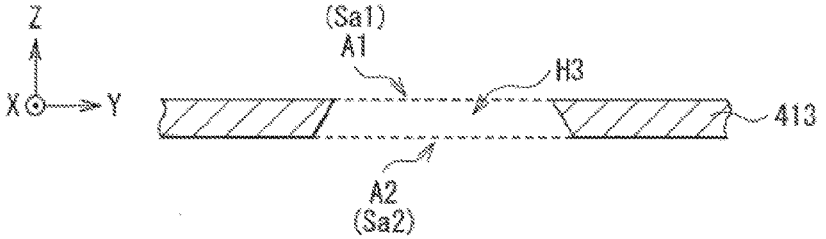

Here, a stacked structure Example of such an intermediate plate 413, the actuator plate 411 and the nozzle plate 412 will be described in detail with reference to FIGS. 7A through 7C. FIGS. 7A through 7C are each a diagram schematically showing a part of the head chip 41 shown in FIG. 3 in an enlarged manner. Specifically, FIG. 7A shows a schematic plan view (a plan view in the X-Y plane), and FIG. 7B shows a schematic cross-sectional view (a cross-sectional view in the Z-X plane), respectively. Further, FIG. 7C shows a schematic cross-sectional view (a cross-sectional view in the Z-Y plane) regarding only the intermediate plate 413.

It should be noted that in FIG. 7A and FIG. 7B there is provided the illustration defining the length in the X-axis direction of each of the channels C1 as channel width Lc, and the length in the X-axis direction of the drive wall Wd as drive wall width Lw. Further, in FIG. 7A and FIG. 7B, the inlet diameter Rin and the outlet diameter Rout (each the length in the X-axis direction) of the nozzle hole H2 described above are also illustrated.

Here, as shown in FIG. 7A, FIG. 7B and FIG. 7C, in each of the through holes H3 in the intermediate plate 413, an opening region A2 opposed to the nozzle plate 412 is made larger than an opening region A1 opposed to the actuator plate 411. In other words, the opening area Sa2 as the area (the area on the X-Y plane) of the opening region A2 is made larger than the opening area Sa1 as the area (the area on the X-Y plane) of the opening region A1 (Sa1<Sa2). In other words, the length (opening width La2) in the X-axis direction in the opening region A2 is made larger than the length (opening width La1) in the X-axis direction in the opening region A1 (La1<La2).

Incidentally, as shown in FIG. 7A and FIG. 7B, in the through holes H3 of the present embodiment, the opening width La1 of the opening region A1 is made larger than the channel width Lc of the channels C1 (La1>Lc). Further, the opening region A1 extends from an opposed region to the ejection channel C1*e* to opposed regions to the drive walls Wd on both sides adjacent to that ejection channel C1*e*. Similarly, the opening region A2 also extends from the opposed region to the ejection channel C1*e* to the opposed regions to the drive walls Wd on the both sides adjacent to that ejection channel C1*e*. Therefore, in each of the through holes H3 of the present embodiment, both of the opening regions A1, A2 extend to the opposed regions to the drive walls Wd on the both sides adjacent to the ejection channel C1*e*, and are arranged not to reach an opposed region to the dummy channel C1*d*.

Further, as shown in FIG. 7B and FIG. 7C, each of the through holes H3 of the present embodiment includes an inverse tapered part having the cross-sectional area gradually increasing from the opening region A1 to the opening region A2. In particular, in the intermediate plate 413, the entire through hole H3 forms the inverse tapered through hole gradually increasing in the cross-sectional area from the opening region A1 to the opening region A2. Incidentally, it is arranged that such inverse tapered through holes H3 are formed by, for example, applying a blast process or an anisotropic etching process to the intermediate plate 413.

Here, such an intermediate plate 413 corresponds to a specific Example of a "third plate" in the present disclosure. Further, the opening region A1 corresponds to a specific Example of a "first opening region" in the present disclosure, and the opening region A2 corresponds to a specific Example of a "second opening region" in the present disclosure.

Operations and Functions/Advantages (A. Basic Operation of Printer 1)

In the printer 1, a recording operation (a printing operation) of images and characters to the recording paper P is performed in the following manner. It should be noted that as the initial state, it is assumed that the four types of ink tanks 3 (3Y, 3M, 3C, and 3B) shown in FIG. 1 are sufficiently filled with the ink 9 of the corresponding colors (the four colors), respectively. Further, there is kept the state in which the ink 9 in the ink tank 3 is supplied to the pressure buffer 42*b* via the supply tube 50 due to the water head difference. Therefore, there is kept the state in which a predetermined amount of the ink 9 is supplied to the ink introducing hole 410*a* of the head chip 41 via the ink connection pipe 42*c* and the flow channel member 42*a*, and thus, the ejection channel C1*e* is filled with the predetermined amount of the ink 9 via the slit 410*b*.

In such an initial state, when operating the printer 1, the grid rollers 21 in the carrying mechanisms 2*a*, 2*b* rotate to thereby carry the recording paper P along the carrying direction d (the X-axis direction) between the grid rollers 21 and the pinch rollers 22. Further, at the same time as such a carrying operation, the drive motor 633 in the drive mechanism 63 respectively rotates the pulleys 631*a*, 631*b* to thereby operate the endless belt 632. Thus, the carriage 62 reciprocates along the width direction (the Y-axis direction) of the recording paper P while being guided by the guide rails 61*a*, 61*b*. Then, on this occasion, the four colors of ink 9 are appropriately ejected on the recording paper P by the respective inkjet heads 4 (4Y, 4M, 4C, and 4B) to thereby perform the recording operation of images, characters, and so on to the recording paper P.

(B. Detailed Operation in Inkjet Head 4)

Then, the detailed operation (the jet operation of the ink 9) in the inkjet head 4 will be described with reference to FIG. 1 through FIG. 6. Specifically, in the inkjet head 4

(edge-shoot type) according to the present embodiment, the jet operation of the ink 9 using a shear mode is performed in the following manner.

Firstly, when the reciprocation of the carriage 62 (see FIG. 1) described above is started, the drive circuit 43*b* applies the drive voltage to the drive electrodes Ed in the inkjet head 4 (the head chip 41) via the flexible board 43*c*. Specifically, the drive circuit 43*b* applies the drive voltage to the drive electrodes Ed disposed on the pair of drive walls Wd partitioning the ejection channel C1*e*. Thus, the pair of drive walls Wd each deform (see FIG. 5 and FIG. 6) so as to protrude toward the dummy channel C1*d* adjacent to the ejection channel C1*e*.

Here, as described above, the drive electrodes Ed are formed only to the intermediate position in the depth direction on the inside surfaces in the drive walls Wd. Therefore, by applying the drive voltage using the drive circuit 43*b*, it results that the drive wall Wd makes a flexion deformation to have a V shape centered on the intermediate position in the depth direction in the drive wall Wd. Further, due to such a flexion deformation of the drive wall Wd, the ejection channel C1*e* deforms as if the ejection channel C1*e* bulges.

As described above, due to the flexion deformation caused by a piezoelectric thickness-shear effect in the pair of drive walls Wd, the capacity of the ejection channel C1*e* increases. Further, by increasing the capacity of the ejection channel C1*e*, the ink 9 in the ink introducing hole 410*a* is induced into the ejection channel C1*e* via the slit 410*b* as a result (see FIG. 5 and FIG. 6).

Subsequently, the ink 9 having been induced into the ejection channel C1*e* in such a manner turns to a pressure wave to propagate to the inside of the ejection channel C1*e*. Then, the drive voltage to be applied to the drive electrodes Ed becomes 0 (zero) V at the timing at which the pressure wave has reached the nozzle hole H2 of the nozzle plate 412. Thus, the drive walls Wd are restored from the state of the flexion deformation described above, and as a result, the capacity of the ejection channel C1*e* having once increased is restored again (see FIG. 5 and FIG. 6).

When the capacity of the ejection channel C1*e* is restored in such a manner, the internal pressure of the ejection channel C1*e* increases, and the ink 9 in the ejection channel C1*e* is pressurized. As a result, the ink 9 having a droplet shape is ejected (see FIG. 5 and FIG. 6) toward the outside (toward the recording paper P) through the nozzle hole H2. The jet operation (the ejection operation) of the ink 9 in the inkjet head 4 is performed in such a manner, and as a result, the recording operation of images, characters, and so on to the recording paper P is performed.

In particular, the nozzle holes H2 of the present embodiment each have the tapered cross-sectional shape gradually decreasing in diameter toward the outlet (see FIG. 7) as described above, and can therefore eject the ink 9 straight (good in straightness) at high speed. Therefore, it becomes possible to perform recording high in image quality.

(C. Functions/Advantages)

Then, the functions and the advantages in the head chip 41, the inkjet head 4 and the printer 1 according to the present embodiment will be described in detail while comparing with a comparative example.

Comparative Example

Figure 8A:
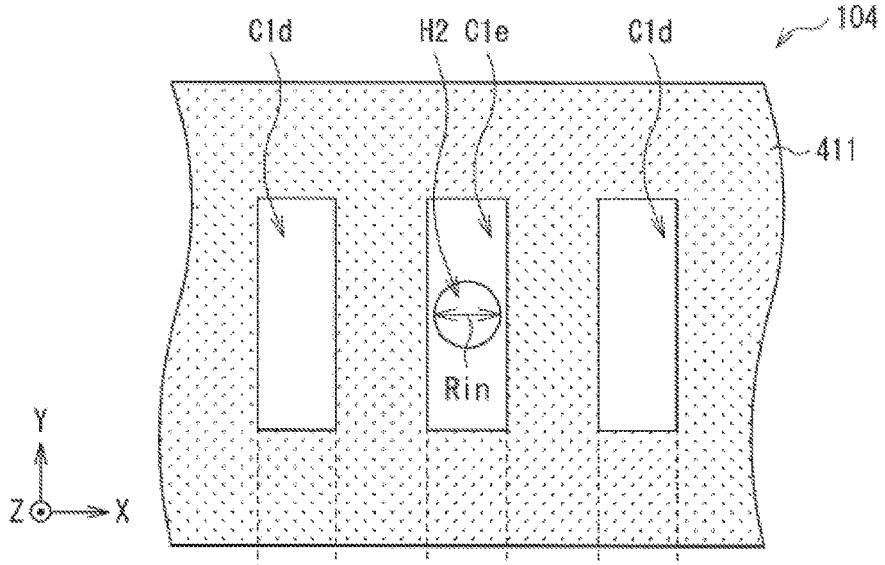
FIG. 8A is a schematic plan view showing a part of a head chip according to a comparative Example in an enlarged manner.
Figure 8B:
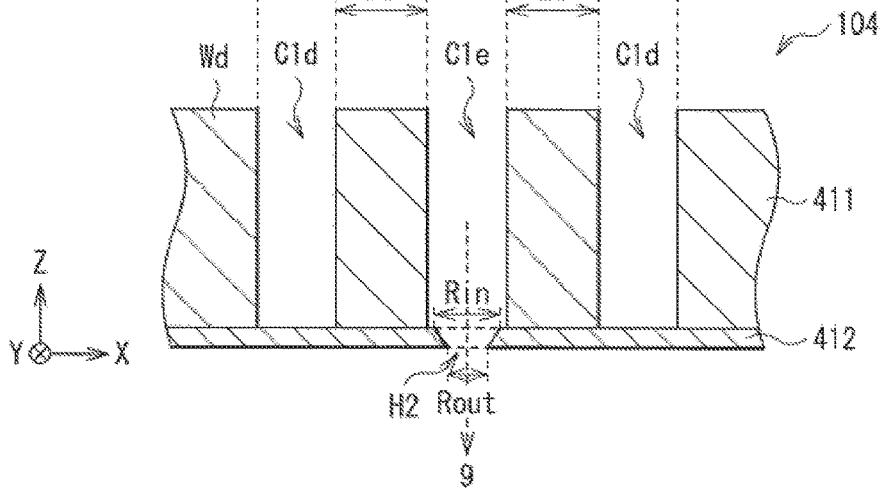
FIG. 8B is a schematic cross-sectional view showing a part of the head chip according to the comparative Example in an enlarged manner.
Figure 9A:
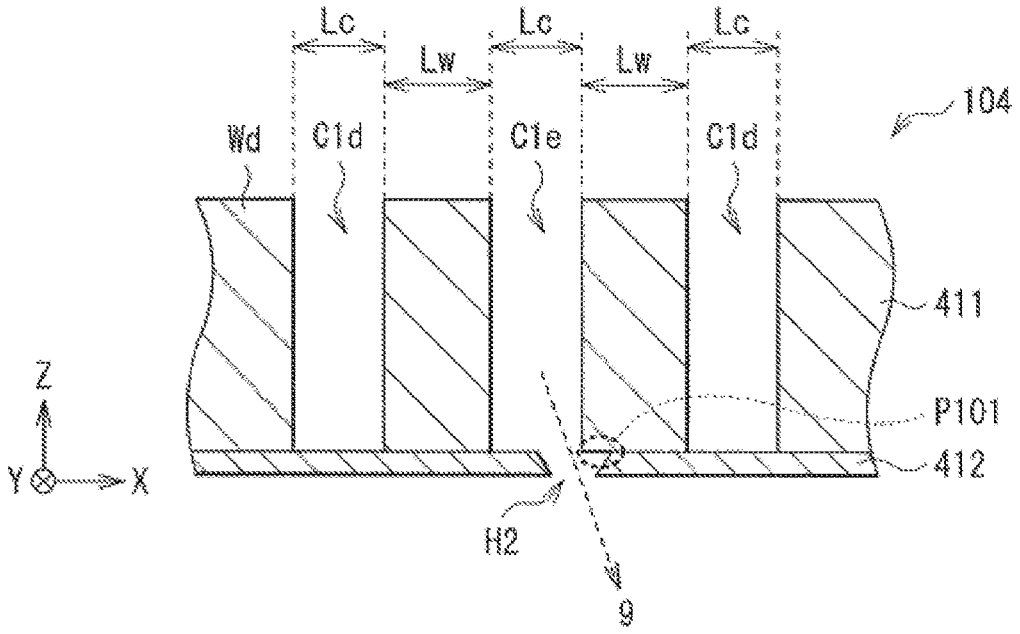
FIG. 9A is a schematic cross-sectional view showing an Example of a liquid jet operation in the case in which a misalignment occurs in the head chip according to the comparative example.
Figure 9B:
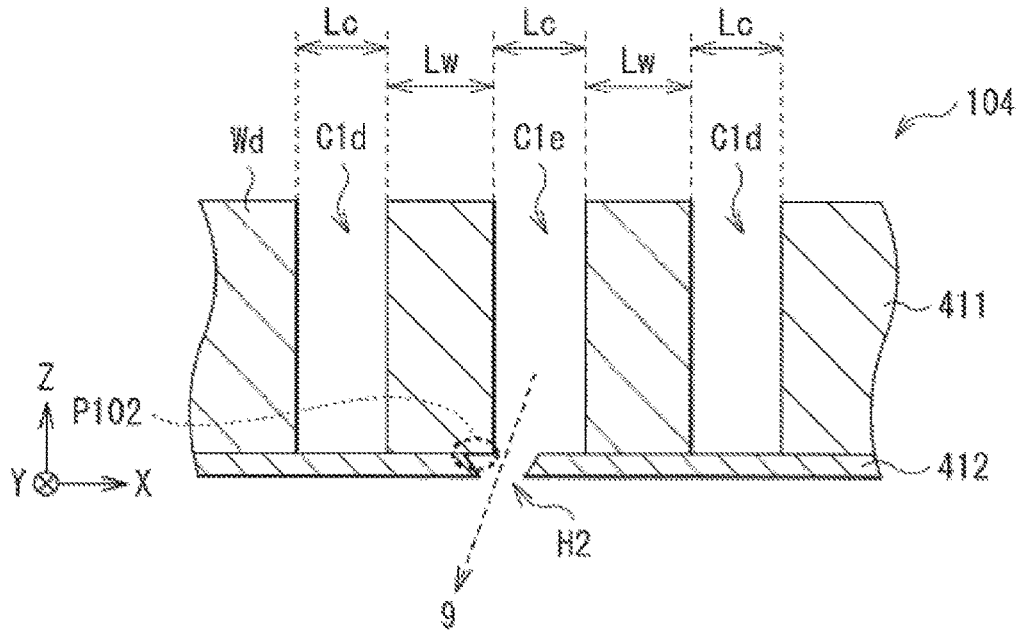
FIG. 9B is a schematic cross-sectional view showing another Example of the liquid jet operation in the case in which the misalignment occurs in the head chip according to the comparative example.

FIGS. 8A and 8B are each a diagram schematically showing a part of a head chip (a head chip 104) related to a comparative Example in an enlarged manner. Specifically, FIG. 8A shows a schematic plan view (a plan view in the X-Y plane), and FIG. 8B shows a schematic cross-sectional view (a cross-sectional view in the Z-X plane), respectively. Further, FIG. 9A and FIG. 9B are each a cross-sectional view (a cross-sectional view in the Z-X plane) schematically showing a jet operation Example of the ink 9 in the case in which a misalignment of the nozzle plate 412 described later occurs in the head chip 104 according to the present comparative example.

As shown in FIG. 8A and FIG. 8B, the head chip 104 corresponding to what is arranged not to dispose the intermediate plate 413 between the actuator plate 411 and the nozzle plate 412 in the head chip 41 according to the present embodiment shown in FIG. 7A and FIG. 7B. In other words, in the head chip 104, it is arranged that the actuator plate 411 and the nozzle plate 412 are directly bonded to each other using an adhesive without intervention of the intermediate plate 413 between the actuator plate 411 and the nozzle plate 412.

Specifically, when assembling the head chip 104, the process of directly attaching the nozzle plate 412 to the actuator plate 411 is performed in, for example, the following manner. Specifically, firstly, an adhesive (e.g., an epoxy adhesive) having a thermosetting property is applied to the front end surface described above in the actuator plate 411. Subsequently, the nozzle plate 412 is made to have contact with the front end surface of the actuator plate 411 while performing the positioning between the ejection channels C1*e* of the actuator plate 411 and the nozzle holes H2 of the nozzle plate 412 so as to obtain the arrangement positions shown in, for example, FIG. 8B. Then, by performing a thermal treatment in such a contact state, the actuator plate 411 and the nozzle plate 412 are bonded to each other, and are thus directly bonded to each other as a result.

Here, in the head chip 104 of such a comparative example, there is a possibility that, for example, the following problem occurs. That is, firstly, in the case of attempting to increase the recording density of images, characters and so on to the recording paper P (in the case of achieving the high resolution), the pitch (the length of the channel width Lc or the drive wall width Lw) between the channels C1 (the ejection channels C1*e*) decreases in the head chip 104, and thus, the narrow pitch is achieved. Further, in the case of achieving such high resolution, if attempting to ensure the droplet size of the ink 9 in roughly the same level as in the related art, it results that the diameters (the inlet diameter Rin and the outlet diameter Rout) of each of the nozzle holes H2 are also ensured to have roughly the same size as in the related art in the nozzle plate 412.

However, in the case of attempting to ensure the diameter of the nozzle hole H2 while achieving the high resolution, positioning of the nozzle holes H2 becomes difficult when directly attaching (bonding) the nozzle plate 412 to the actuator plate 411 as described above. Specifically, as shown in, for example, FIG. 8B, since the allowable range of the error is small in positioning the nozzle holes H2 to the ejection channels C1*e*, the possibility that the misalignment between the nozzle holes H2 and the ejection channels C1*e* occurs becomes high.

Further, in the case in which the end part of each of the nozzles H2 has been displaced from the opposed region to the ejection channel C1*e* to the opposed region to the drive wall Wd adjacent to the ejection channel C1*e* as shown in, for example, FIG. 9A and FIG. 9B, there is a possibility that such an ejection failure of the ink 9 as described below occurs. That is, if the adhesive flows into the nozzle hole H2 in the place indicated by the reference symbols P101, P102 in FIG. 9A and FIG. 9B, for example, there is a possibility that the ejection direction of the ink 9 is tilted (the ejection operation toward an oblique direction occurs) due to pressure convergence unevenness (see FIG. 9A and FIG. 9B).

In such a manner, in the head chip 104 of the comparative example, when positioning the nozzle holes H2 of the nozzle plate 412 to the ejection channels C1*e* of the actuator plate 411, there is a possibility that the ejection failure of the ink 9 occurs due to the fact that the allowable range of the error is small. Further, if there is a possibility that such an ejection failure of the ink 9 occurs, it results that the reliability deteriorates in the head chip 104 (and the inkjet head and the printer equipped with the head chip 104).

Present Embodiment

In contrast, in the head chip 41 of the present embodiment, the intermediate plate 413 having the plurality of through holes H3 is disposed between the actuator plate 411 and the nozzle plate 412 as shown in FIG. 7A and FIG. 7B. Further, in the through holes H3 in the intermediate plate 413, the opening region A2 (the opening area Sa2) opposed to the nozzle plate 412 is made larger than the opening region A1 (the opening area Sa1) opposed to the actuator plate 411.

Thus, in the head chip 41 of the present embodiment, the allowable range of the error in the positioning described above becomes larger compared to the head chip 104 of the comparative Example described above. In other words, in the head chip 41, the allowable range of the error when positioning the nozzle holes H2 to the ejection channels C1*e* becomes large in the case of attaching the nozzle plate 412 toward the actuator plate 411 via the intermediate plate 413.

The reason therefor is as follows. That is, firstly, in the head chip 104 of the comparative Example shown in FIG. 8A and FIG. 8B, a half of a difference between the channel width Lc and the inlet diameter Rin of the nozzle hole H2 (=(Lc−Rin)/2) is the allowable range of the error in the positioning. In contrast, in the head chip 41 of the present embodiment shown in FIG. 7A and FIG. 7B, a half of a difference between an opening width La2 of the opening region A2 in the through hole H3 and the inlet diameter Rin of the nozzle hole H2 (=(La2−Rin)/2) is the allowable range of the error in the positioning. Further, as described above, the opening width La1 of the opening region A1 is made larger than the channel width Lc (La1>Lc), and at the same time, the opening width La2 in the opening region A2 is made larger than the opening width La1 in the opening region A1 (La1<La2). Due to these facts, it can be said that in the head chip 41 of the present embodiment, the allowable range of the error in the positioning described above becomes larger compared to the head chip 104 of the comparative Example described above.

As an example, in the case in which the channel width Lc is set to Lc=70 μm and the inlet diameter Rin of the nozzle hole H2 is set to Rin=60 μm, in the head chip 104 of the comparative Example described above, the allowable range of the error in the positioning becomes (Lc−Rin)/2=±5 μm, and thus, the allowable range becomes extremely small. In contrast, in the head chip 41 of the present embodiment, assuming that the opening width La2 in the opening region A2 is La2=100 μm, the allowable range of the error in positioning in this case becomes (La2−Rin)/2=±20 μm, and thus, the allowable range becomes extremely large compared to the comparative example.

In such a manner as described above, in the head chip 41 according to the present embodiment, since the allowable range of the error in the positioning described above becomes larger compared to the head chip 104 of the comparative example, the ejection failure of the ink 9 due to the misalignment becomes difficult to occur compared to the comparative Example described above.

Figure 10A:
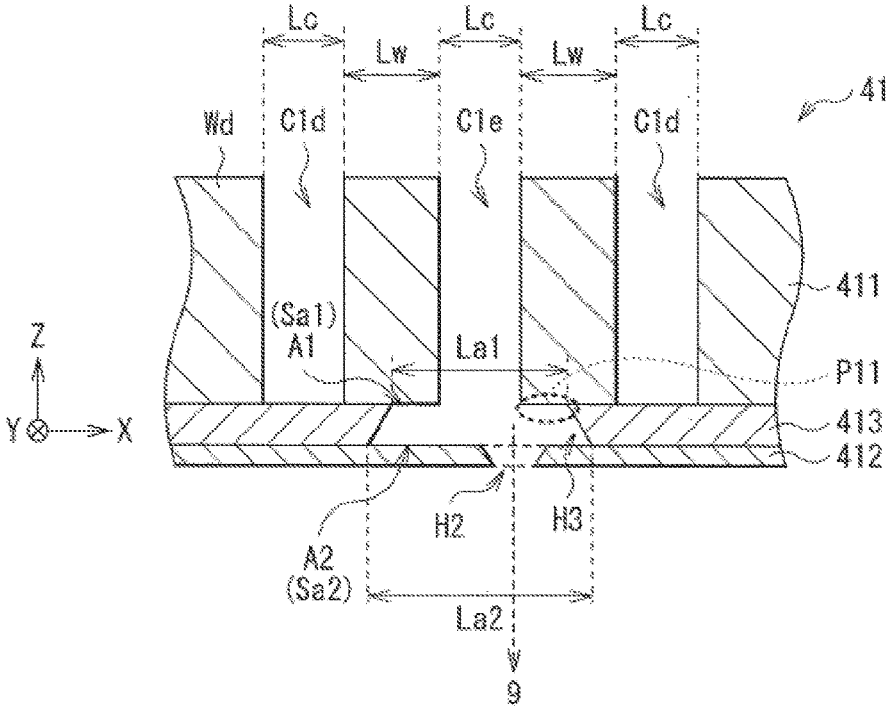
FIG. 10A is a schematic cross-sectional view showing an Example of the liquid jet operation in the case in which the misalignment occurs in a head chip according to the present embodiment.
Figure 10B:
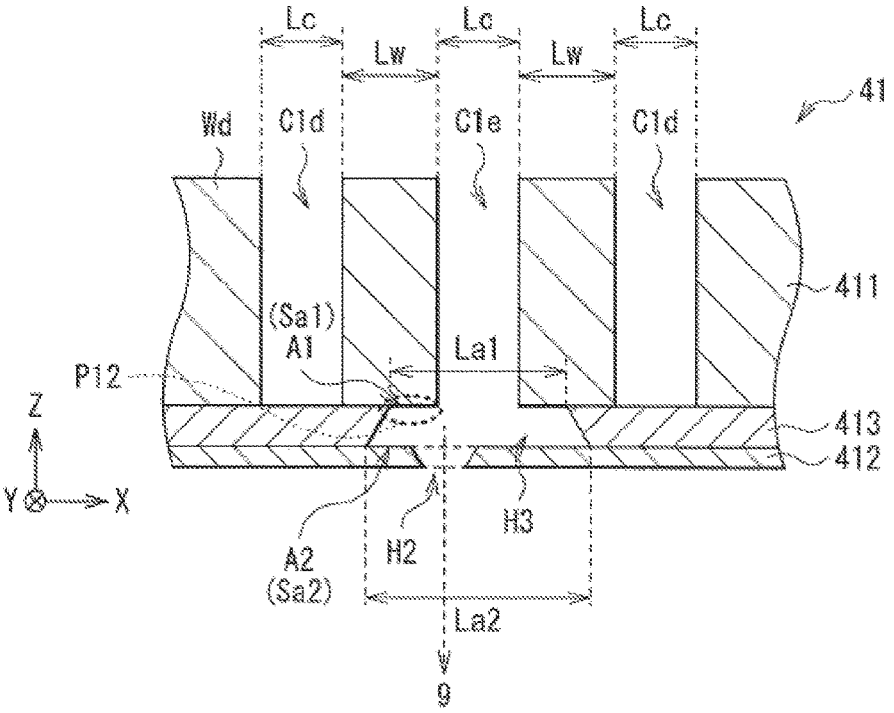
FIG. 10B is a schematic cross-sectional view showing another Example of the liquid jet operation in the case in which the misalignment occurs in the head chip according to the present embodiment.

Here, FIG. 10A and FIG. 10B are each a cross-sectional view (a cross-sectional view in the Z-X plane) schematically showing a jet operation Example of the ink 9 in the case in which the misalignment of the nozzle plate 412 occurs in the head chip 41 according to the present embodiment. Even in the case in which the end part of each of the nozzles H2 has been displaced from the opposed region to the ejection channel C1*e* to the opposed region to the drive wall Wd adjacent to the ejection channel C1*e* as shown in FIG. 10A and FIG. 10B, the ejection failure of the ink 9 does not occur in the present embodiment unlike the case of the comparative Example shown in FIG. 9A and FIG. 9B. Therefore, even in such a case, since there is no chance for the adhesive to flow into the nozzle hole H2 (see the reference symbols P11, P12 in FIG. 10A and FIG. 10B), it is avoided that the ejection direction of the ink 9 is tilted (the ejection operation toward the oblique direction occurs) (see FIG. 10A and FIG. 10B).

As described above, in the head chip 41 of the present embodiment, since it is arranged that the intermediate plate 413 having the plurality of through holes H3 each having the opening region A2 larger than the opening region A1 is disposed between the actuator plate 411 and the nozzle plate 412, the head chip 41 results in the following. That is, in the case of attaching the nozzle plate 412 toward the actuator plate 411 via the intermediate plate 413, the ejection failure and so on of the ink 9 due to the misalignment of the nozzle holes H2 can be suppressed. Therefore, it becomes possible to enhance the reliability of the head chip 41 (and the inkjet head 4 and the printer 1) in the present embodiment compared to the comparative example.

Further, in the head chip 41 of the present embodiment, since the through hole H3 forms the inverse tapered through hole gradually increasing in the cross-sectional area from the opening region A1 to the opening region A2, there can be obtained the following advantage, for example. That is, since the through holes H3 are each the inverse tapered through hole, it becomes easy to form the difference in the area (the difference between the opening area Sa1 and the opening area Sa2) between the opening region A1 and the opening region A2 using the single plate in the intermediate plate 413. Therefore, since the intermediate plate 413 can be formed of a single plate (member), it becomes possible to manufacture the whole of the head chip 41 at low cost compared to the case of, for example, forming the intermediate plate 413 using a multilayer plate.

Further, in the head chip 41 of the present embodiment, unlike the head chip 104 of the comparative example, since it is not required to consider the inflow of the adhesive into the nozzle hole H2 described above, it becomes possible to, for example, make it easy to achieve the narrow pitch and the high resolution of the head chip 41 described above.

2. MODIFIED EXAMPLES

Then, some modified examples (Modified Examples 1 through 4) will be described. It should be noted that the same constituents as those in the embodiment are denoted by the same reference symbols, and the description thereof will arbitrarily be omitted.

Modified Example 1

Figure 11:
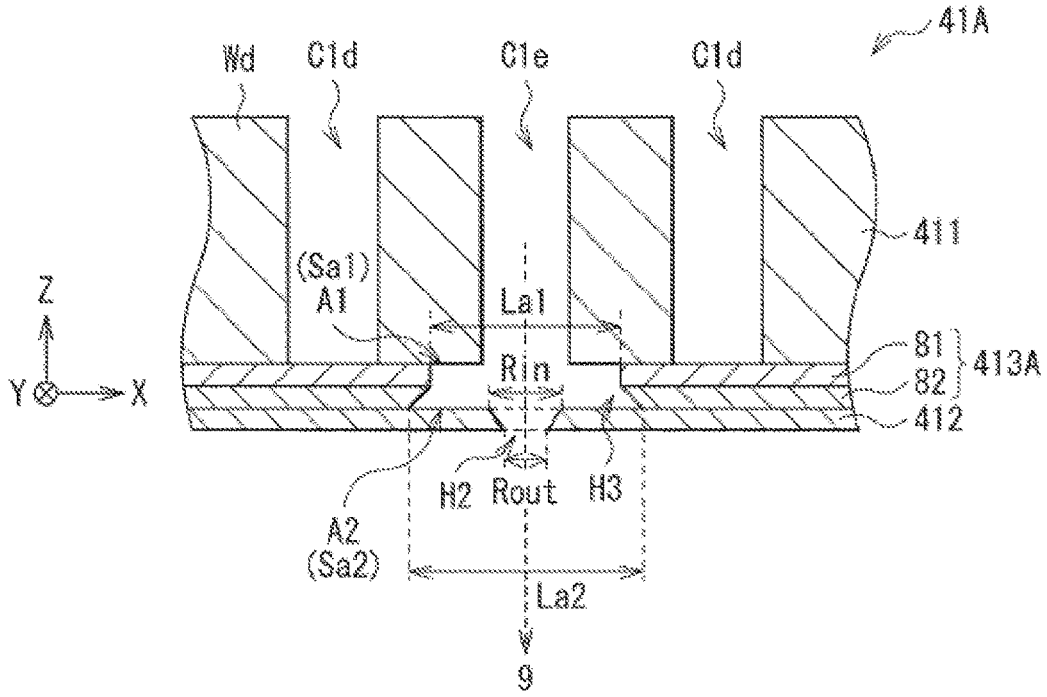
FIG. 11 is a schematic cross-sectional view showing a part of a head chip according to Modified Example 1 in an enlarged manner.

FIG. 11 is a cross-sectional view (a cross-sectional view in the Z-X plane) schematically showing a part of a head chip (a head chip 41A) related to Modified Example 1 in an enlarged manner.

The head chip 41A of the present modified Example corresponds to what is provided with an intermediate plate 413A described below instead of the intermediate plate 413 in the head chip 41 of the embodiment, and the other constituents are made basically the same. Further, the intermediate plate 413A corresponds to what is obtained by changing the shapes of the plurality of through holes H3 in the intermediate plate 413, and at the same time constituted by a plurality of layers of plates (two layers of plates 81, 82 in the present modified example) instead of the single plate. It should be noted that such an intermediate plate 413A corresponds to a specific Example of the "third plate" in the present disclosure.

Specifically, as shown in FIG. 11, firstly, in the intermediate plate 413A, similarly to the intermediate plate 413, in each of the through holes H3, the opening region A2 opposed to the nozzle plate 412 is made larger than the opening region A1 opposed to the actuator plate 411. In other words, in the intermediate plate 413A, similarly to the intermediate plate 413, the opening area Sa2 of the opening region A2 is made larger than the opening area Sa1 of the opening region A1 (Sa1<Sa2), and at the same time, the opening width La2 is made larger than the opening width La1 (La1<La2). Further, in the through holes H3 of the intermediate plate 413A, similarly to the through holes H3 of the intermediate plate 413, the opening width La1 is made larger than the channel width Lc of the channels C1 (La1>Lc).

It should be noted that in the through holes H3 of the intermediate plate 413A, unlike the through holes H3 (the inverse tapered through holes) of the intermediate plate 413, the following is arranged. That is, the intermediate plate 413A is constituted by a plate 81 in the first stage provided with the through holes H3 in the first stage each having the opening width La1, and a plate 82 in the second stage provided with the through holes H3 in the second stage each having the inverse tapered shape. In other words, in each of the inverse tapered through holes H3 in the plate 82 in the second stage, the cross-sectional area gradually increases from the opening width La1 to the opening width La2 (>La1). In other words, this means that each of the through holes H3 of the whole of the intermediate plate 413A includes the inverse tapered part (the portion of the through hole in the plate 82 of the second stage) having the cross-sectional area gradually increasing from the opening region A1 to the opening region A2.

In the head chip 41A of the present modified Example having such a configuration, it is possible to obtain basically the same advantage due to the same function as that of the head chip 41 of the embodiment.

Modified Example 2

Although in each of the embodiment described above and Modified Example 1, there is described the Example of the case in which the intermediate plate has the inverse tapered through holes, an Example of the case in which the intermediate plate has step-like through holes will be described in Modified Example 2 below.

Configuration

Figure 12A:
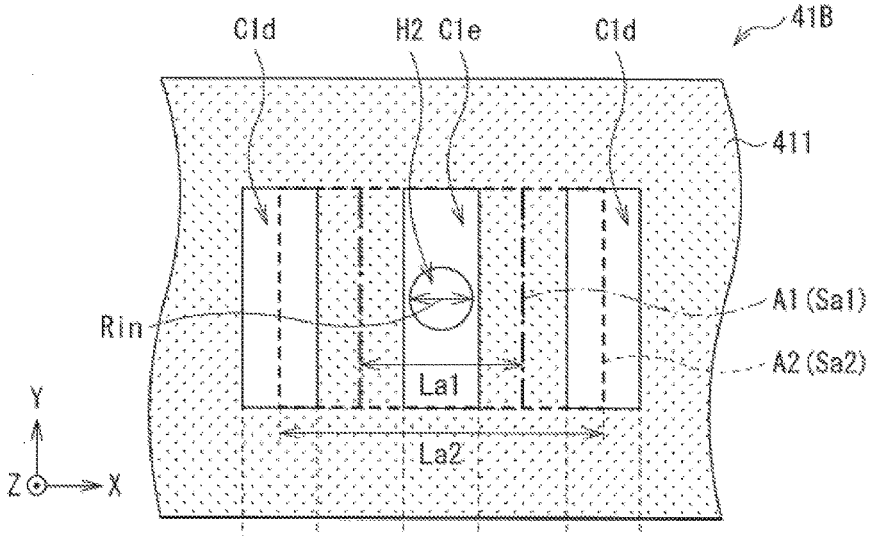
FIG. 12A is a schematic plan view showing a part of a head chip according to Modified Example 2 in an enlarged manner.
Figure 12B:
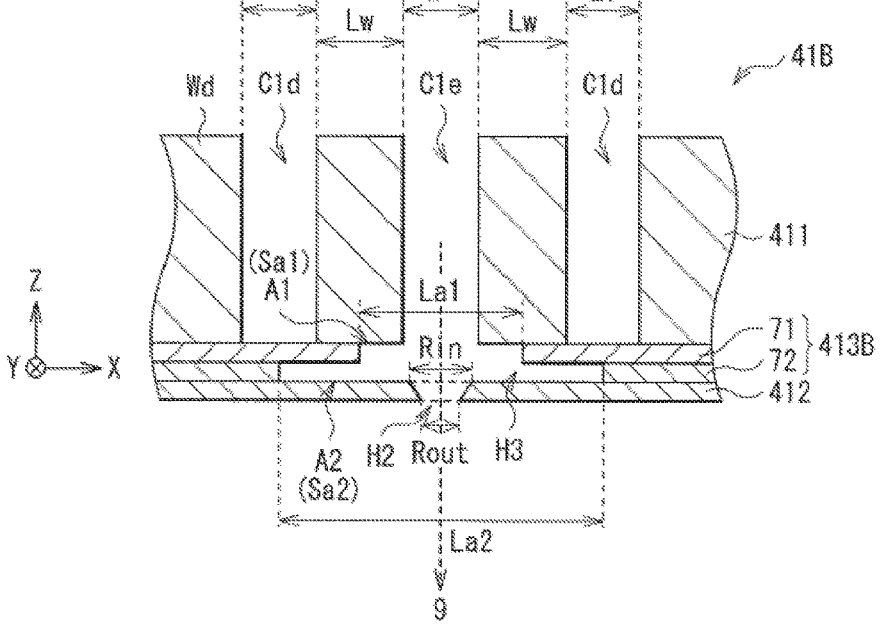
FIG. 12B is a schematic cross-sectional view showing a part of the head chip according to Modified Example 2 in an enlarged manner.

FIGS. 12A and 12B are each a diagram schematically showing a part of a head chip (a head chip 41B) related to Modified Example 2 in an enlarged manner. Specifically, FIG. 12A shows a schematic plan view (a plan view in the X-Y plane), and FIG. 12B shows a schematic cross-sectional view (a cross-sectional view in the Z-X plane), respectively.

The head chip 41B of the present modified Example corresponds to what is provided with an intermediate plate 413B described below instead of the intermediate plate 413 in the head chip 41 of the embodiment, and the other constituents are made basically the same. Further, the intermediate plate 413B corresponds to what is obtained by changing the shapes of the plurality of through holes H3 in the intermediate plate 413, and at the same time constituted by a plurality of layers of plates (two layers of plates 71, 72 in the present modified example) instead of the single plate. It should be noted that such an intermediate plate 413B corresponds to a specific Example of the "third plate" in the present disclosure.

Specifically, as shown in FIG. 12A and FIG. 12B, firstly, in the intermediate plate 413B, similarly to the intermediate plate 413, in each of the through holes H3, the opening region A2 opposed to the nozzle plate 412 is made larger than the opening region A1 opposed to the actuator plate 411. In other words, in the intermediate plate 413B, similarly to the intermediate plate 413, the opening area Sa2 of the opening region A2 is made larger than the opening area Sa1 of the opening region A1 (Sa1<Sa2), and at the same time, the opening width La2 is made larger than the opening width La1 (La1<La2). Further, in the through holes H3 of the intermediate plate 413B, similarly to the through holes H3 of the intermediate plate 413, the opening width La1 is made larger than the channel width Lc of the channels C1 (La1>Lc).

It should be noted that in the through holes H3 of the intermediate plate 413B, unlike the through holes H3 (the inverse tapered through holes) of the intermediate plate 413, the cross-sectional area in each of the through holes H3 increases stepwise from the opening region A1 to the opening region A2. Specifically, in the Example shown in FIG. 12A and FIG. 12B, the number of stages of the steps in the step-like cross-sectional area is set to two. In other words, the intermediate plate 413B is constituted by a plate 71 in the first stage provided with the through holes H3 in the first stage each having the opening width La1, and a plate 72 in the second stage provided with the through holes H3 in the second stage each having the opening width La2 (>La1).

Further, as shown in FIG. 12A and FIG. 12B, in the intermediate plate 413B, unlike the intermediate plate 413, the opening region A2 of the through holes H3 extends from the opposed region to the ejection channel C1*e* to the opposed region of the dummy channel C1*d* adjacent to that ejection channel C1*e*. Specifically, in this example, La2>(Lc+2×Lw) is true.

Functions/Advantages

In the head chip 41B of the present modified Example having such a configuration, it is possible to obtain basically the same advantage due to the same function as that of the head chip 41 of the embodiment.

Specifically, also in the head chip 41B of the present modified example, since it is arranged that the intermediate plate 413 having the plurality of through holes H3 each having the opening region A2 larger than the opening region A1 is disposed between the actuator plate 411 and the nozzle plate 412, the head chip 41B results in the following. That is, in the case of attaching the nozzle plate 412 toward the actuator plate 411 via the intermediate plate 413B, the ejection failure and so on of the ink 9 due to the misalignment of the nozzle holes H2 can be suppressed. Therefore, also in the present modified example, it becomes possible to enhance the reliability of the head chip 41B compared to the comparative Example described above.

Further, in particular in the head chip 41B of the present modified example, since the cross-sectional area in each of the through holes H3 of the intermediate plate 413B increases stepwise from the opening region A1 to the opening region A2, it becomes possible to obtain, for example, the following advantage. That is, it becomes possible to dramatically change the sizes and the shapes of the opening regions A1, A2 in each of the through holes H3. Further, it becomes easy to, for example, make the member different by the stage in the step-like through holes H3 to make the intermediate plate 413B multilayered (to achieve the multilayered plate with the two plates 71, 72 in this example). Specifically, in the case in which, for example, the thermal expansion coefficient is significantly different between the actuator plate 411 and the nozzle plate 412, by making the intermediate plate 413B include a member (either one of the plates 71, 72 in this example) the thermal expansion coefficient of which is an intermediate value between the thermal expansion coefficients of the actuator plate 411 and the nozzle plate 412, it becomes easy to absorb the stress due to the deformation of the head chip 41B. As a result, for example, it becomes difficult for the actuator plate 411, the intermediate plate 413B and the nozzle plate 412 to be separated from each other. Therefore, it becomes possible to enhance the degree of freedom in designing the head chip 41B, and at the same time, it becomes also possible to improve the durability (reliability) of the head chip 41B.

Further, in the head chip 41B of the present modified example, since the opening region A2 in each of the through holes H3 of the intermediate plate 413B extends from the opposed region to the ejection channel C1*e* to the opposed region to the dummy channel C1*d* adjacent to that ejection channel C1*e*, it becomes possible to obtain, for example, the following advantage. That is, the allowable range of the error in the positioning of each of the nozzle holes H2 further increases, and at the same time, the ink 9 is not ejected from the opposed region to the dummy channel C1*d*, no harmful influence on the jet operation occurs. Therefore, it becomes possible to further enhance the reliability of the head chip 41B.

Modified Examples 3, 4

In all of the embodiment described above and Modified Examples 1, 2, the description is presented citing the non-cyclic type inkjet head through which the ink 9 does not circulate as an example. In both of Modified Examples 3, 4 below, an application Example to the liquid cyclic type inkjet head through which the ink 9 circulates will be described.

Incidentally, in the liquid cyclic type inkjet head, it is arranged that the ink 9 circulates between the inside of the head chip and the outside (the inside of the ink tank 3) of the head chip as described below in detail. In such a liquid cyclic type inkjet head, since the flesh ink 9 is always supplied to the vicinity of the nozzle holes H2, even in the case of using the fast drying type ink 9, the ink in the vicinity of the nozzle holes H2 is prevented from drying, and it becomes possible to reduce the ejection failure of the ink 9.

Configuration of Modified Examples 3

Figure 13A:
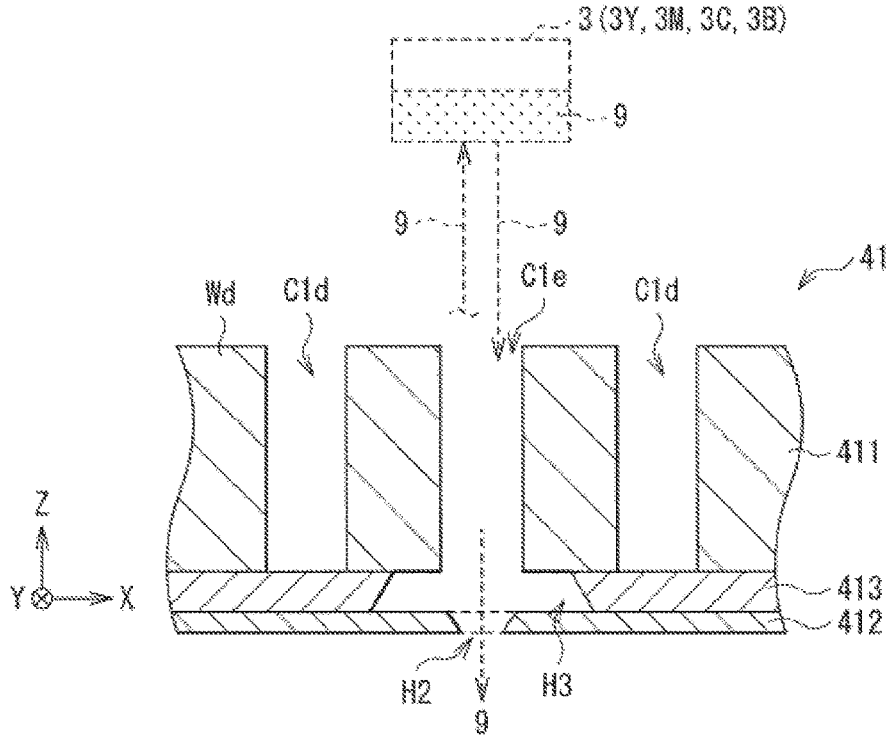
FIG. 13A is a schematic cross-sectional view showing a part of a head chip according to Modified Example 3-1 in an enlarged manner.
Figure 13B:
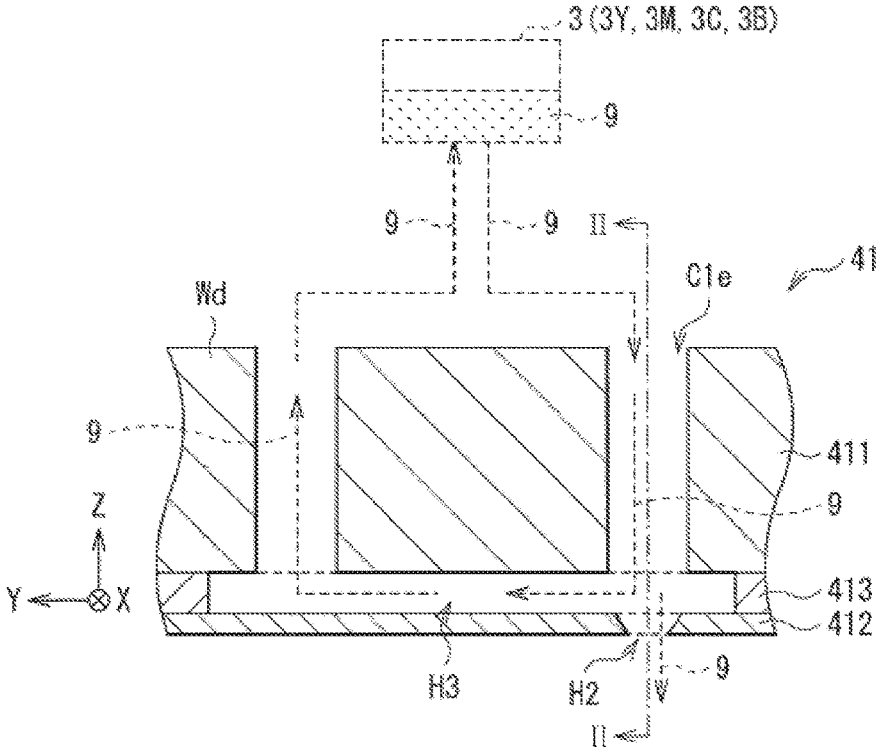
FIG. 13B is a schematic cross-sectional view from another direction in the head chip shown in FIG. 13A.
Figure 13C:
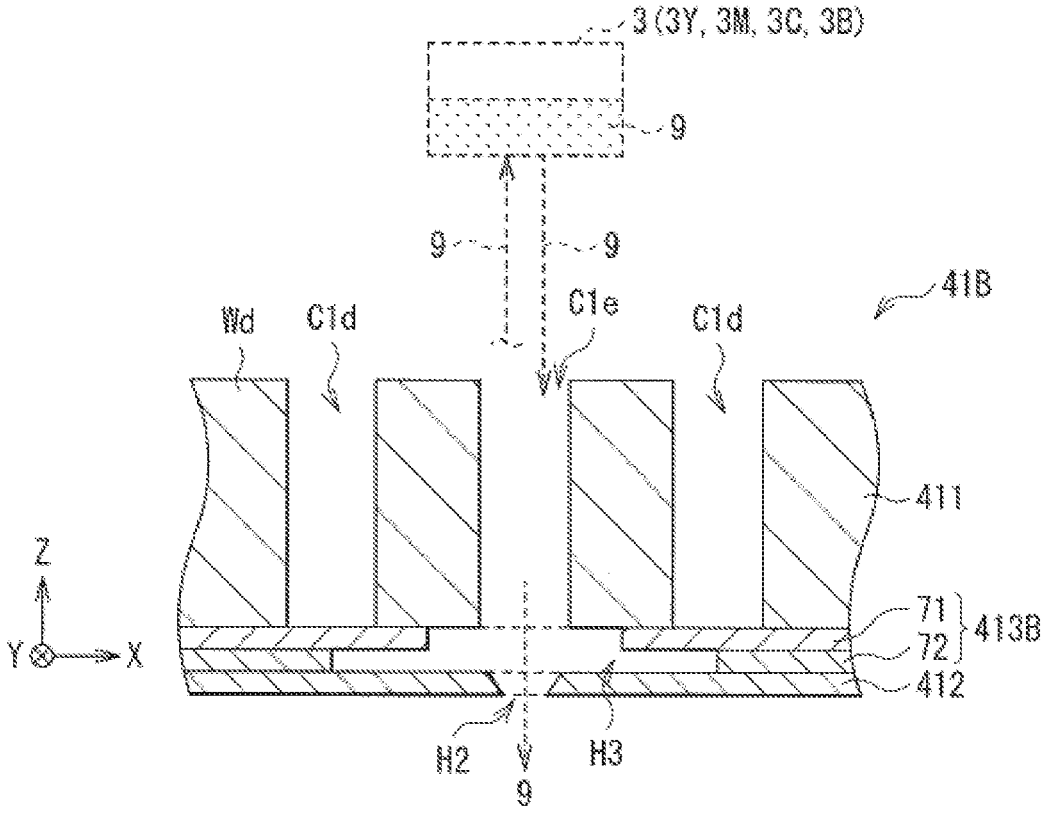
FIG. 13C is a schematic cross-sectional view showing a part of a head chip according to Modified Example 3-2 in an enlarged manner.

FIG. 13A and FIG. 13C are each a cross-sectional view (a cross-sectional view in the Z-X plane) schematically showing a part of the head chip related to Modified Examples 3 (Modified Examples 3-1, 3-2) in an enlarged manner. Further, FIG. 13B is a cross-sectional view (a cross-sectional view in the Y-Z plane) schematically showing a part of the head chip related to Modified Example 3-1 shown in FIG. 13A. It should be noted that the cross-sectional view along the line II-II shown in FIG. 13B corresponds to the cross-sectional view shown in FIG. 13A.

In each of the head chips of Modified Examples 3-1, 3-2, it is arranged that the intermediate plate having the plurality of through holes H3 also functions as a return plate having a flow channel of the ink 9 as described below. Specifically, the through holes H3 (return paths) in the intermediate plate (the return plate) are each communicated with the ink tank in the printer via an ink outlet in the inkjet head. Then, it is arranged that a cyclic mechanism for reusing the ink 9 which has not been used for the ejection in the head chip is provided to the inkjet head.

Specifically, in the head chip 41 related to Modified Example 3-1 shown in FIG. 13A and FIG. 13B, it is arranged that the intermediate plate 413 described in the embodiment also functions as the return plate having the flow channel of the ink 9. Further, it is arranged that the ink 9 circulating between the inside of the head chip 41 and the inside of the ink tank 3 flows into the head chip 41 (the ejection channel C1*e*), and at the same time outflows from the inside of the head chip 41 through the through holes H3 (the return path) in the intermediate plate 413 (see FIG. 13A and FIG. 13B).

Further, in the head chip 41B related to Modified Example 3-2 shown in FIG. 13C, it is arranged that the intermediate plate 413B described in Modified Example 2 also functions as the return plate having the flow channel of the ink 9. Further, it is arranged that the ink 9 circulating between the inside of the head chip 41B and the inside of the ink tank 3 flows into the head chip 41B (the ejection channel C1*e*), and at the same time outflows from the inside of the head chip 41B through the through holes H3 (the return path) in the intermediate plate 413B (see FIG. 13C).

Configuration of Modified Examples 4

Figure 14A:
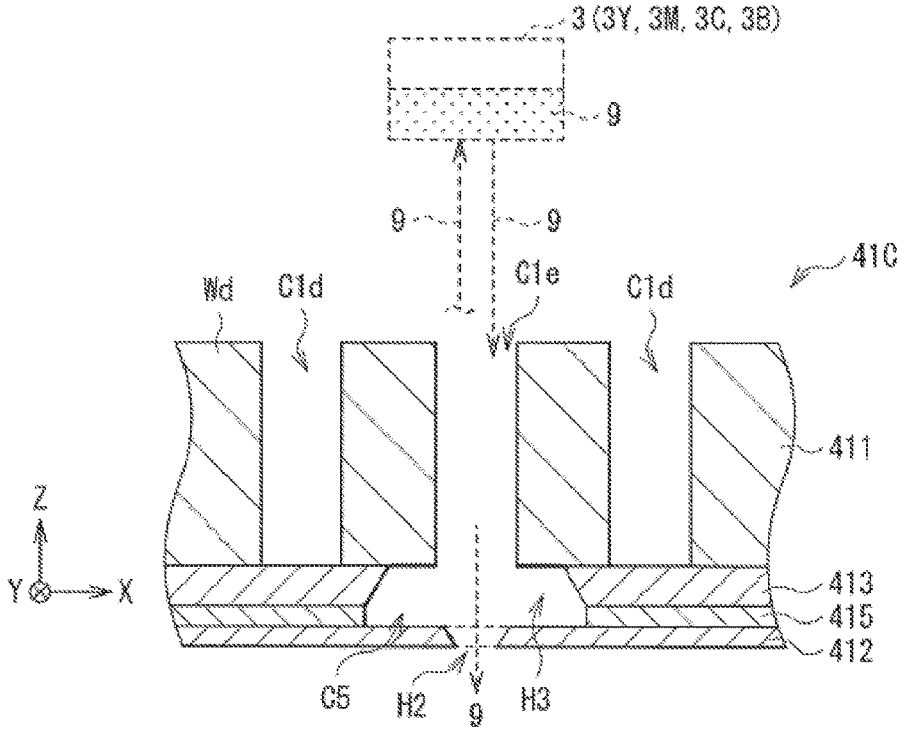
FIG. 14A is a schematic cross-sectional view showing a part of a head chip according to Modified Example 4-1 in an enlarged manner.
Figure 14B:
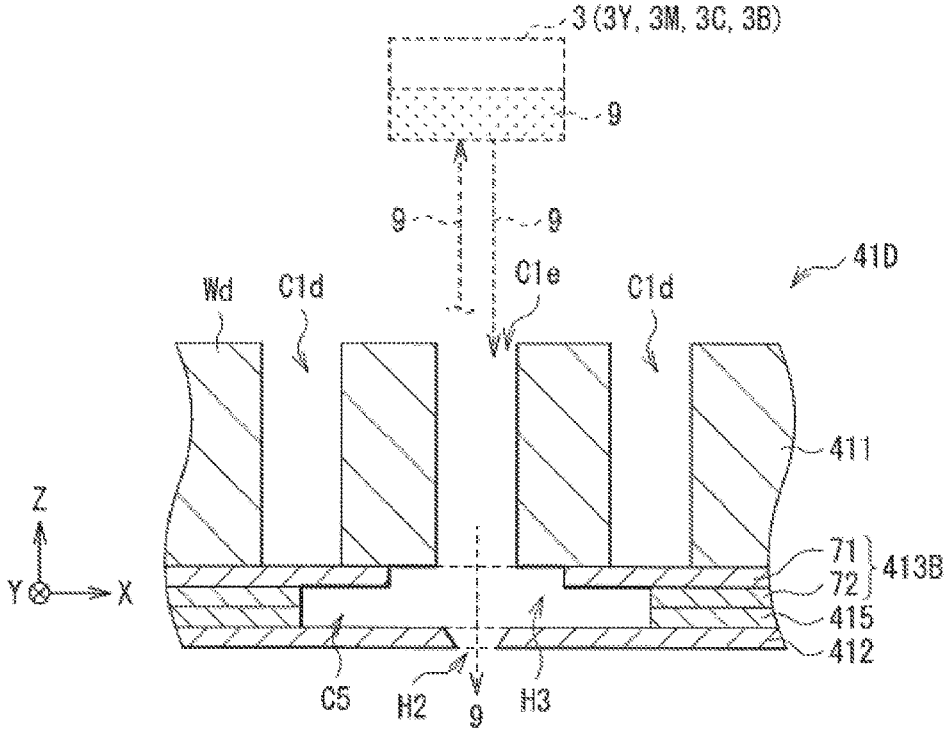
FIG. 14B is a schematic cross-sectional view showing a part of a head chip according to Modified Example 4-2 in an enlarged manner.

FIG. 14A and FIG. 14B are each a cross-sectional view (a cross-sectional view in the Z-X plane) schematically showing a part of the head chip related to Modified Examples 4 (Modified Examples 4-1, 4-2) in an enlarged manner. In each of the head chips of Modified Examples 4-1, 4-2, it is arranged that a return plate having a flow channel of the ink 9 is provided separately from the intermediate plate having the plurality of through holes H3 as described below.

Specifically, in the head chip 41C related to Modified Example 4-1 shown in FIG. 14A, it is arranged that the return plate 415 having the flow channel C5 (the return path) of the ink 9 is provided separately from the intermediate plate 413 described in the embodiment. In detail, in the head chip 41C, such a return plate 415 is disposed between the intermediate plate 413 and the nozzle plate 412. Further, it is arranged that the ink 9 circulating between the inside of the head chip 41C and the inside of the ink tank 3 flows into the head chip 41C (the ejection channel C1*e*), and at the same time outflows from the inside of the head chip 41C through the through holes H3 in the intermediate plate 413 and the flow channel C5 of the return plate 415 (see FIG. 14A).

Further, in the head chip 41D related to Modified Example 4-2 shown in FIG. 14B, it is arranged that the return plate 415 having the flow channel C5 (the return path) of the ink 9 is provided separately from the intermediate plate 413B described in Modified Example 2. In detail, in the head chip 41D, such a return plate 415 is disposed between the intermediate plate 413B and the nozzle plate 412. Further, it is arranged that the ink 9 circulating between the inside of the head chip 41D and the inside of the ink tank 3 flows into the head chip 41D (the ejection channel C1*e*), and at the same time outflows from the inside of the head chip 41D through the through holes H3 in the intermediate plate 413B and the flow channel C5 of the return plate 415 (see FIG. 14B).

Functions/Advantages of Modified Examples 3, 4

In each of the head chips of Modified Examples 3, 4 having such configurations, since it is arranged that the intermediate plates 413, 413B described in the embodiment and Modified Example 2 are applied to the liquid cyclic type inkjet head, Modified Examples 3, 4 result in the following. That is, it becomes possible to obtain, for example, the following advantages in addition to the advantage in the embodiment and Modified Example 2. Specifically, it becomes difficult to cause stagnation in the flow of the ink 9 when the ink 9 flows through the head chip via the through holes H3. Therefore, in each of Modified Examples 3, 4, it is possible to achieve stabilization of the circulation operation of the ink 9, and it becomes possible to further enhance the reliability of the head chip.

Further, in the case in which the through holes H3 of the intermediate plate 413 have the inverse tapered shape as in the head chips related to the Modified Examples 3-1, 4-1 shown in FIG. 13A and FIG. 14A, the advantage of making it difficult to cause the stagnation in the flow of the ink 9 as described above becomes particularly significant. Therefore, in these cases, it is possible to achieve further stabilization of the circulation operation of the ink 9, and it becomes possible to further enhance the reliability of the head chip.

3. OTHER MODIFIED EXAMPLES

The present disclosure is described hereinabove citing the embodiment and some modified examples, but the present disclosure is not limited to the embodiment and so on, and a variety of modifications can be adopted.

For example, in the embodiment described above, the description is presented specifically citing the configuration examples (the shapes, the arrangements, the number and so on) of each of the members in the printer, the inkjet head and the head chip, but those described in the above embodiment and so on are not limitations, and it is possible to adopt other shapes, arrangements, numbers and so on. Further, the values or the ranges, the magnitude relation and so on of a variety of parameters described in the above embodiment and so on are not limited to those described in the above embodiment and so on, but can also be other values or ranges, other magnitude relation and so on.

Specifically, for example, in the modified examples described above, in the case in which the cross-sectional area of each of the through holes H3 increases stepwise, the description is presented citing the Example in which the number of the stages of the steps is set to two, but this Example is not a limitation, and it is also possible to adopt, for example, a multiple stage having three or more stages. Further, in the embodiment and so on described above, in the case in which the through holes H3 each have the inverse tapered shape, the description is presented citing the Example in which the opening region A2 does not extend to the opposed region to the dummy channel C1*d*, but this Example is not a limitation. That is, similarly to the case in which the cross-sectional area of each of the through holes H3 increases stepwise as described in the above modified example, even in the case in which the through holes H3 each have the inverse tapered shape, it is possible to assume that the opening region A2 extends to the opposed region to the dummy channel C1*d*.

Further, for example, in the above embodiment and so on, the description is presented citing the Example of the case in which the cross-sectional shape of each of the through holes H3 is a rectangular shape, the cross-sectional shape of each of the through holes H3 is not limited to this example, but can also be, for example, a circular shape, an elliptical shape, a polygonal shape such as a triangular shape, or a star shape. Further, the cross-sectional shape of each of the nozzle holes H2 is not limited to the circular shape as described in the above embodiment and so on, but can also be, for example, an elliptical shape, a polygonal shape such as a triangular shape, or a start shape.

In addition, the "head chip" in the present disclosure can be applied not only to the head chips of the types described in the above embodiment and so on, but also to head chips of other types such as a head chip of a so-called rooftop type or a head chip of a so-called bubble type. It should be noted that in the head chip of the rooftop type described above, a plurality of pump chambers corresponding to a "plurality of pressure chambers" of the present disclosure is disposed in the plate corresponding to the "first plate" of the present disclosure, and at the same time, an actuator mechanism is disposed in an upper part of the plate.

Further, the series of processes described in the above embodiment and so on can be arranged to be performed by hardware (a circuit), or can also be arranged to be performed by software (a program). In the case of arranging that the series of processes is performed by the software, the software is constituted by a program group for making the computer perform the function. The programs can be incorporated in advance in the computer described above, and are then used, or can also be installed in the computer described above from a network or a recording medium and are then used.

Further, in the above embodiment, the description is presented citing the printer 1 (the inkjet printer) as a specific Example of the "liquid jet recording device" in the present disclosure, but this Example is not a limitation, and it is also possible to apply the present disclosure to other devices than the inkjet printer. In other words, it is also possible to arrange that the "head chip" (the head chips 41, 41A, 41B, 41C, and 41D) and the "liquid jet head" (the inkjet heads 4) of the present disclosure are applied to other devices than the inkjet printer. Specifically, for example, it is also possible to arrange that the "head chip" and the "liquid jet head" of the present disclosure are applied to a device such as a facsimile or an on-demand printer.

In addition, it is also possible to apply the variety of examples described hereinabove in arbitrary combination.

It should be noted that the advantages described in the specification are illustrative only but are not a limitation, and another advantage can also be provided.

Further, the present disclosure can also take the following configurations:

(1) A head chip adapted to jet a liquid including a first plate having a plurality of pressure chambers adapted to apply pressure to the liquid, a second plate having a plurality of nozzle holes adapted to jet the liquid in response to application of the pressure, and a third plate disposed between the first and second plates, and provided with a plurality of through holes individually communicated with the plurality of pressure chambers and the plurality of nozzle holes, respectively, wherein in the through hole, a second opening region opposed to the second plate is larger than a first opening region opposed to the first plate.

(2) The head chip described in (1) wherein the through hole includes an inverse tapered part gradually increasing in cross-sectional area from the first opening region to the second opening region.

(3) The head chip described in (2) wherein the cross-sectional area in the through hole increases stepwise from the first opening region to the second opening region.

(4) The head chip described in (3) wherein in the first plate, a plurality of ejection channels as the plurality of pressure chambers filled with the liquid, and a plurality of dummy channels not filled with the liquid are alternately arranged side by side, and the second opening region in the through hole extends from an opposed region to the ejection channel to an opposed region to the dummy channel adjacent to the ejection channel.

(5) The head chip described in any one of (1) to (4) wherein there is a configuration in which the liquid circulating between an inside of the head chip and an outside of the head chip flows into the head chip, and outflows from an inside of the head chip through the through hole.

(6) The head chip described in any one of (1) to (5) wherein a thermal expansion coefficient in the third plate has a value between a thermal expansion coefficient in the first plate and a thermal expansion coefficient in the second plate.

(7) A liquid jet head including the head chip described in any one of (1) to (6), and a supply mechanism adapted to supply the liquid to the head chip.

(8) A liquid jet recording device including the liquid jet head described in (7), and a containing section adapted to contain the liquid.

What is claimed is:

1. A head chip adapted to jet a liquid comprising:

a first plate having a plurality of pressure chambers adapted to apply pressure to the liquid;

a second plate having a plurality of nozzle holes adapted to jet the liquid in response to application of the pressure; and a third plate disposed between the first and second plates, and provided with a plurality of through holes individually communicated with the plurality of pressure chambers and the plurality of nozzle holes, respectively, wherein in the through hole, a second opening region opposed to the second plate is larger than a first opening region opposed to the first plate, in the first plate, a plurality of ejection channels as the plurality of pressure chambers filled with the liquid, and a plurality of dummy channels which are channels not filled with the liquid, are alternately arranged side by side, and the second opening region in the through hole extends from an opposed region to the ejection channel to an opposed region to the dummy channel adjacent to the ejection channel.

2. The head chip according to claim 1, wherein the through hole includes an inverse tapered part gradually increasing in cross-sectional area from the first opening region to the second opening region.

3. The head chip according to claim 1, wherein the cross-sectional area in the through hole increases stepwise from the first opening region to the second opening region.

4. The head chip according to claim 1, wherein there is a configuration in which the liquid circulating between an inside of the head chip and an outside of the head chip flows into the head chip, and outflows from an inside of the head chip through the through hole.

5. The head chip according to claim 1, wherein a thermal expansion coefficient in the third plate has a value between a thermal expansion coefficient in the first plate and a thermal expansion coefficient in the second plate.

6. A liquid jet head comprising:

the head chip according to claim 1; and a supply mechanism adapted to supply the liquid to the head chip.

7. A liquid jet recording device comprising:

the liquid jet head according to claim 6; and a containing section adapted to contain the liquid.

* * * * *